US011479930B2

(12) United States Patent
Abeles

(10) Patent No.: US 11,479,930 B2
(45) **Date of Patent: *Oct. 25, 2022**

(54) MUDSLIDE EROSION INHIBITOR

(71) Applicant: Gary E. Abeles, Verona, NJ (US)

(72) Inventor: Gary E. Abeles, Verona, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/481,801

(22) Filed: Sep. 22, 2021

(65) Prior Publication Data

US 2022/0010508 A1 Jan. 13, 2022

Related U.S. Application Data

(63) Continuation-in-part of application No. 17/179,048, filed on Feb. 18, 2021, now Pat. No. 11,149,393, which is a continuation-in-part of application No. 16/904,047, filed on Jun. 17, 2020, now Pat. No. 10,954,641, which is a continuation-in-part of application No. 16/480,476, filed as application No. PCT/US2018/012781 on Jan. 8, 2018, now Pat. No. 10,718,095.

(Continued)

(51) Int. Cl.

| | |
|---|---|
| ***E02B 3/04*** | (2006.01) |
| ***E01F 7/04*** | (2006.01) |
| ***E02B 3/10*** | (2006.01) |

(52) U.S. Cl.

CPC ..... *E01F 7/04* (2013.01); *E02B 3/108* (2013.01)

(58) Field of Classification Search

CPC ..... E02B 3/04; E02B 3/108; E02B 3/06

See application file for complete search history.

(56) References Cited

U.S. PATENT DOCUMENTS

| | | | |
|---|---|---|---|
| 2,474,786 | A | 6/1949 | Humphrey |
| 3,280,569 | A | 10/1966 | Wosenitz |

(Continued)

FOREIGN PATENT DOCUMENTS

| | | | |
|---|---|---|---|
| CN | 202280039 | U | 6/2012 |
| WO | 2006031525 | A2 | 3/2006 |

OTHER PUBLICATIONS

PCT International Search Report and Written Opinion for Appl No. PCT/US2018/012781 dated Apr. 27, 2018, 12 pages.

(Continued)

*Primary Examiner* — Benjamin F Fiorello

(74) *Attorney, Agent, or Firm* — Maine Cernota & Rardin

(57) ABSTRACT

A barrier structure for impeding erosion due to mudslides allows mud to enter through large holes in a barrier wall, and water separated from soil to drain out through smaller holes in a rear wall. An underlying reservoir can further stabilize the structure by rapidly collect water and/or mud. A backstop wall and/or an extension can be abutted to a top of the barrier wall to enhance mud collection during a mudslide. The structure can further include a penetrating passage enabling a fraction of impacting mud to flow through unimpeded, and/or a diverting wedge uphill of the apparatus diverts some impacting mud and debris while allowing a remainder thereof to pass through to the barrier wall. A plurality of the barrier structures can be installed such that mud flowing past an uphill structure impacts a downhill structure. The barrier structure can be constructed from biodegradable materials.

17 Claims, 24 Drawing Sheets

Related U.S. Application Data

(60) Provisional application No. 62/451,394, filed on Jan. 27, 2017.

(56) References Cited

U.S. PATENT DOCUMENTS

| | | | | |
|---|---|---|---|---|
| 3,386,250 | A | 6/1968 | Susumu | |
| 3,653,216 | A | 4/1972 | Stickler, Jr. | |
| 3,844,125 | A | 10/1974 | Williams, Sr. | |
| 4,129,006 | A | 12/1978 | Payne | |
| 4,367,978 | A | 1/1983 | Schaaf et al. | |
| 4,479,740 | A | 10/1984 | Schaaf | |
| 4,711,598 | A | 12/1987 | Schaaf | |
| 4,726,708 | A * | 2/1988 | Papetti | E02D 29/0208 405/32 |
| 4,818,141 | A | 4/1989 | Rauch | |
| 4,978,247 | A | 12/1990 | Lenson | |
| 5,102,257 | A | 4/1992 | Creter | |
| 5,176,468 | A | 1/1993 | Poole | |
| 5,405,217 | A | 4/1995 | Dias | |
| 5,564,369 | A | 10/1996 | Barber | |
| 5,655,851 | A | 8/1997 | Chor | |
| 5,791,827 | A * | 8/1998 | Arvai | E02D 29/025 405/286 |
| D417,314 | S | 11/1999 | Smith, Jr. | |
| 6,565,283 | B1 | 5/2003 | Hall | |
| 6,616,383 | B2 | 9/2003 | Janz | |
| 6,672,799 | B2 | 1/2004 | Earl | |
| 7,384,217 | B1 * | 6/2008 | Barrett | E02D 17/20 405/15 |
| 8,226,325 | B1 | 7/2012 | Pierce, Jr. | |
| 8,585,318 | B1 | 11/2013 | Walker | |
| 8,747,023 | B1 | 6/2014 | Walker | |
| 9,157,204 | B2 | 10/2015 | Pierce, Jr. | |
| 10,718,095 | B2 | 7/2020 | Abeles | |
| 2001/0026735 | A1 * | 10/2001 | Price | E02D 29/025 52/610 |
| 2006/0056913 | A1 | 3/2006 | Herzog | |
| 2006/0159518 | A1 | 7/2006 | Cravens | |
| 2006/0275081 | A1 | 12/2006 | Medina Folgado | |
| 2009/0154996 | A1 | 6/2009 | Liner | |
| 2010/0310313 | A1 | 12/2010 | Kohlenberg | |
| 2016/0348327 | A1 | 12/2016 | Martin | |
| 2017/0342673 | A1 | 11/2017 | O'Sullivan | |

OTHER PUBLICATIONS

International Preliminary Report on Patentability for Appl No. PCT/US2018/012781 dated Jul. 30, 2019, 8 pages.

Office Action for U.S. Appl. No. 16/904,047, dated Aug. 20, 2020, 8 Pages.

Notice of Allowance for U.S. Appl. No. 16/904,047, dated Nov. 25, 2020, 10 Pages.

Office Action for Chinese Patent Appl. No. 201880008696.9, dated Oct. 20, 2020, 9 Pages.

Notice of Allowance for U.S. Appl. No. 17/179,048 dated Jun. 23, 2021, 13 pages.

Foreign Office Action for Patent Application No. 201880008696.9, dated May 17, 2021, 11 pages.

* cited by examiner

MUDSLIDE EROSION INHIBITOR

RELATED APPLICATIONS

This application is a continuation in part of U.S. application Ser. No. 17/179,048 filed on Feb. 18, 2021. Application Ser. No. 17/179,048 is a continuation in part of U.S. application Ser. No. 16/904,047 filed on Jun. 17, 2020, now U.S. Pat. No. 10,954,641. U.S. application Ser. No. 16/904,047 is a continuation in part of U.S. application Ser. No. 16/480,476, filed on Jul. 24, 2019, now U.S. Pat. No. 10,718,095. Application Ser. No. 16/480,476 is a national phase application of PCT application PCT/US2018/012781, filed on Jan. 8, 2018. Application PCT/US2018/012781 claims the benefit of U.S. Provisional Application No. 62/451,394, filed Jan. 27, 2017. All of these applications are herein incorporated by reference in their entirety for all purposes.

FIELD OF THE INVENTION

The invention relates to apparatus and methods of reducing and reversing soil erosion, and more particularly to apparatus and methods for capturing and retaining soil and debris carried by mudslides.

BACKGROUND OF THE INVENTION

During intense forest fires, a waxy substance derived from the burning plant material is formed. Initially created as a gas, this substance penetrates into the soil and then hardens, creating what is called a hydrophobic layer beneath the upper layers of soil. This hydrophobic layer prevents water from sinking deeply into the soil, such that when rain falls heavily onto a mountain or other sloping surface after a forest fire, the rain water has no choice but to flow downhill on and near the surface of the soil, typically carrying with it soil and debris. The result is what is commonly referred to as a mudslide. Mudslides can also occur on a slope that has been subjected to unusually heavy rainfall over an extended period of time, even if the slope has not experienced a forest fire.

Attempts to mitigate the occurrence of mudslides on hills and mountains typically involve placing logs, cement barriers, or other heavy blocking objects in the paths of potential or actual mudslides. However, this approach is often impractical, due to the logistic difficulties of transporting very heavy objects to what are often remote locations. Furthermore, this approach is sometimes ineffective, due to the very large amount of energy that can be carried by a mudslide, which can cause the mudslide to simply push the log, cement barrier, or other blocking object out of the way, or carry it downhill with the mudslide.

In principle, mudslides can be mitigated by terraforming of the terrain using heavy equipment, so that barriers are formed against mudslides, and so that any hydrophobic layer is broken up and removed. However, this approach is not always practical, due at least to the inaccessibility of the mudslide area to heavy equipment, and due to a desire not to create unnatural structures in wilderness and forest areas.

What is needed, therefore, is an apparatus and method for mitigating soil erosion caused by mudslides, where the apparatus is relatively light in weight, easy and inexpensive to transport and install, and easy to remove and relocate after natural regrowth of vegetation has broken through the hydrophobic layer, stabilized the soil, and reduced the likelihood of mudslides.

SUMMARY OF THE INVENTION

The present invention is a barrier structure and method of use thereof for mitigating soil erosion caused by mudslides, where the barrier structure is relatively light in weight, easy and inexpensive to transport and install, and easy to remove and relocate after natural regrowth of vegetation has broken through any hydrophobic layer, stabilized the soil, and reduced the likelihood of mudslides.

Rather than providing a barrier having an intrinsically high mass, such as a concrete barrier or large log, the present invention is configured to increase its effective weight naturally, after installation, by accumulating soil and/or water within its interior, so that the mass of the accumulated soil and/or water stabilizes the barrier structure and enables it to resist the oncoming force of a mudslide. Once the barrier structure is filled and stabilized, additional soil, debris and other materials will typically accumulate in front of the barrier structure and function as an additional barrier that helps to mitigate and deflect the energy of mudslides. Accordingly, the disclosed barrier structure functions in a manner similar to a concrete barrier or log, but is far lighter in weight and easier to transport and remove.

The present invention is specifically configured for use on sloping ground, i.e. ground that is inclined at an angle of inclination from horizontal. The term "slope normal" is used herein to refer to a direction that is perpendicular to the sloping ground. Surfaces having inclinations that are greater than the inclination of the sloping ground are referred to herein as being "inclined downhill," while surfaces having inclinations that are less than the inclination of the sloping ground are referred to herein as being "inclined uphill." It should also be noted that the term "soil" is used herein generically to refer to all relatively small particulates, such as grains of sand and particles of organic matter, that are carried by water in a mudslide, while the term "debris" is used herein generically to refer to any and all relatively large objects, such as brush, tree branches, and rocks, that may also be propelled downhill by a mudslide.

The disclosed barrier structure includes a barrier apparatus that comprises a rigid or semi-rigid barrier wall. The barrier wall is inclined downhill and is penetrated by a plurality of large holes, so that when a mudslide impacts the barrier wall, the mud is directed upward across the front surface of the barrier wall, causing at least some of the mud to enter through the holes into an interior of the barrier apparatus behind the barrier wall, while the larger debris either accumulates uphill of the semi-rigid barrier or flows over the top thereof.

The barrier apparatus further comprises a rear wall that is inclined uphill, and, in embodiments, also a floor and/or one or two side walls, which create a semi- or fully enclosed interior within which the entrained soil within the captured mud settles and separates from the water. Small holes, which are smaller than the large holes, are provided in the rear wall and, in embodiments, in at least one side wall, so that water that has separated from the soil within the interior of the barrier apparatus can drain out and continue to flow downstream, while soil continues to accumulate. In embodiments, the small holes are offset from the base of the sand-collecting barrier apparatus, so as to encourage pooling of mud, whereby the entrained soil has time to settle out and accumulate before the water rises high enough to drain out through the small holes.

In embodiments, the disclosed barrier structure further includes an underlying reservoir that is configured to capture water and/or mud as it flows over the top of the barrier and/or out from the small holes in the rear wall, thereby rapidly increasing the mass of the barrier so that it remains stable while it collects mud within its interior and separates the soil from the water. For example, the underlying reservoir may fill with rain during a heavy rainfall that is followed by a mudslide. In some embodiments, the overlying elements of the barrier apparatus are attachable to and detachable from the underlying reservoir. In other embodiments, the underlying water reservoir is inseparable from the remainder of the barrier apparatus.

In some embodiments, the weight of the collected soil and/or water is sufficient by itself to stabilize the barrier apparatus and enable it to resist mudslides. Other embodiments include an anchoring feature, such as anchor stakes that can be driven into the underlying ground to further stabilize the barrier apparatus against being dislodged by mudslides.

So as to resist the energy of larger mudslides, some embodiments of the disclosed barrier apparatus include a passage that penetrates the barrier apparatus and allows a portion of the impacting mud to flow through the barrier apparatus largely unimpeded, thereby reducing the energy that is applied to the barrier apparatus. Additionally, mud from larger mudslides can flow over the top of the barrier wall, further limiting the fractional amount of mudslide energy that is applied to the barrier apparatus.

In embodiments, the barrier structure further includes a diverting wedge located uphill of the barrier apparatus, and configured as a pair of joined diverting walls that are penetrated by wedge holes and share a common uphill edge. The diverting walls are thereby configured as a wedge that re-directs and diverts incoming debris, and some incoming mud, to either side of the barrier apparatus, while allowing a remainder of the mud to pass through the wedge holes and flow on, with reduced energy, to the barrier apparatus. In various embodiments, the diverting walls include downhill panels that extend to the barrier wall, so that the diverting wedge is stabilized by the mass of collected materials within the barrier apparatus.

In various method embodiments, a plurality of the disclosed barrier structures are implemented to mitigate mudslides, extending from at least one uphill barrier structure to at least one downhill barrier structure, whereby a mudslide serially encounters the plurality of barrier structures as it flows downhill. According to this approach, each of the barrier structures is required to withstand only a fraction of the total mudslide energy, while additional mud flowing through, around, and/or over the barrier structure continues downhill to the next barrier structure in the series. For example, the one or more uphill barrier structures can include deflecting wedges, while the one or more downhill barrier structures are able to resist the remaining energy of a mudslide without requiring deflecting wedges.

In some embodiments, the barrier wall extends above the rear wall, and in some of these embodiments the barrier structure further includes a backstop wall that is provided behind the rear wall, and extends to a point above the top of the rear wall, so that an additional soil collecting chamber is formed between the backstop wall and the rear wall. In these embodiments, the backstop wall is also penetrated by small holes. Some of these embodiments include an underlying reservoir that extends beyond and behind the backstop wall, so that an open region of the underlying reservoir is positioned to receive water that flows out through the small holes provided in the backstop wall, as well as any mud that flows over the top of the barrier wall.

Various embodiments include a soil-collecting extension that can be coupled to the barrier apparatus and underlying water reservoir (if any). The soil-collecting extension includes a top that is penetrated by extension holes, which in embodiments are larger than the "large" holes of the barrier wall. The top of the soil-collecting extension is substantially parallel to the underlying slope, and extends to the upper edge of the barrier wall, so that energetically flowing mud that flows over the top of the barrier wall is caused to flow across the top of the soil-collecting extension, whereupon some of the mud falls through the extension holes and into an interior of the soil-collecting extension. It will be noted that the soil-collecting extension is also sometimes referred to herein simply as the "extension."

The interior of the soil-collecting extension is bounded by a rear wall of the extension and, in embodiments, by two side panels of the extension. The front of the extension is open, so that the top of the soil-collecting extension can extend to the top of the barrier wall. When the extension is attached to the barrier wall, the rear wall or backstop wall becomes the front boundary of the extension interior.

As water and soil fall into the interior of the extension, the soil settles and separates from the water. As the level of water above the soil rises, the water is able to flow through holes or other openings provided in the rear wall of the extension.

Embodiments of the disclosed barrier structure are constructed from plywood, from metal, from a plastic such as acrylic, from fiberglass, from particle board, which may include a laminated coating or veneer, from micro-lattice, from rigid foam, from Styrofoam, from graphene, and/or from any other suitable material. Some embodiments are constructed using bio-degradable materials, such as Ash-Crete, hemperete clay, Timbercrete, bamboo, recycled wood, and other recycled materials, so that it is not necessary to remove the barriers after the danger of mudslides has abated.

Embodiments of the barrier apparatus that require enhanced structural strength include internal partition walls that extend between and reinforce the barrier wall and rear wall. The partition walls are penetrated by additional, large interior holes, so that mud that enters through the large holes provided in the barrier wall is able to flow downward through the interior holes to the bottom of the apparatus interior. Embodiments further include at least one support wall within the underlying water reservoir that helps to support the weight of the overlying portions of the apparatus, especially as the interior of the apparatus fills with deposited soil. The support walls are also penetrated by holes, so that water is able to flow freely within the underlying reservoir.

In some embodiments, additional support walls are included within the interior of the soil-collecting extension so as to provide extra support to the top of the extension.

A first aspect of the present invention is a barrier structure for reducing erosion due to mudslides on a slope having a slope direction that is inclined at a slope inclination angle. The barrier structure comprises a barrier apparatus that includes a barrier wall having a top and a bottom, the barrier wall being inclined at an angle that exceeds the slope inclination angle by least 20 degrees, a first plurality of holes penetrating the barrier wall, a rear wall having a top and a bottom, the rear wall being inclined at an angle that is less than the slope inclination angle, the rear wall being located behind the barrier wall with the top of the rear wall extending to an upper region of the barrier wall so that a chamber space is formed between and bounded by the barrier wall and the rear wall, and a second plurality of holes penetrating the apparatus rear wall, the holes of the second plurality of holes being smaller in diameter than the holes of the first plurality of holes, the first plurality of holes being configured to allow mud to flow through the barrier wall and into the chamber space, and the second plurality of holes being configured to allow water to flow through the apparatus rear wall out of the chamber space.

In embodiments, the chamber space is further bounded by at least one side wall.

Any of the above embodiments can further include an underlying water reservoir located beneath the chamber space and fixed to the barrier wall and apparatus rear wall, the underlying water reservoir being configured to receive and be filled with at least one of mud and water that flows through the second plurality of holes out of the chamber space or over the top of the barrier wall.

Any of the above embodiments can further include a barrier extension comprising an extension top penetrated by a third plurality of holes, and an extension rear wall extending downward from a rear edge of the extension top, a front edge of the extension top being configured to abut the top of the barrier wall when the sand-collecting extension is installed behind the sand-collecting apparatus, such that mud flowing over the top of the barrier wall flows across the extension top. In some of these embodiments, the barrier extension further comprises a pair of opposing extension side walls.

In any of the above embodiments, all components of the barrier structure can be made from biodegradable materials Any of the above embodiments can further include a plurality of anchoring stakes configured to anchor the barrier structure to the slope.

In any of the above embodiments, the barrier wall and rear wall can be pivotable about their bottoms so as to overlap with each other in a substantially flat, folded configuration.

In any of the above embodiments, the barrier apparatus can further comprise an open passage that penetrates through the barrier apparatus and is configured to allow a fraction of mud impacting the barrier wall to proceed past the barrier apparatus substantially unimpeded by the barrier apparatus.

Any of the above embodiments can further include a diverting wedge extending uphill from the barrier wall, the diverting wedge comprising a pair of diverting walls that are penetrated by a fourth plurality of holes, the diverting walls being inclined toward each other at substantially equal and opposite angles relative to the slope direction so that they meet at a common uphill edge, the diverting wedge being configured to allow some mud from a mudslide to pass through the fourth plurality of holes and continue to the barrier wall, while diverting a remainder of mud and debris of the mudslide to either side of the barrier wall.

A second general aspect of the present invention is a method of reducing erosion due to mudslides on a slope having a slope direction that is inclined at a slope inclination angle. The method includes providing a barrier structure according to any embodiment of the first general aspect, installing the barrier structure on a slope that is subject to mudslides, allowing mud to flow through the barrier wall and into the chamber space, allowing water included in the mud within the chamber space to separate from soil included in the mud within the chamber space, and allowing the water within the chamber space to flow out of the chamber space through the second plurality of holes, while the soil within the chamber space is retained therein, the retained soil thereby being added to the effective weight of the barrier apparatus and thereby increasing a stability of the barrier structure.

Some of these embodiments further include, after a danger of mudslides has abated, emptying the retained soil from the barrier chamber and removing the barrier apparatus from the slope.

In any of the above embodiments, the barrier structure can be constructed from biodegradable materials, and the method can further include, after a danger of mudslides has abated, allowing the barrier structure to decompose into the slope In any of the above embodiments, the barrier structure can further include a diverting wedge extending uphill from the barrier wall, the diverting wedge comprising a pair of diverting walls that are penetrated by a fourth plurality of holes, the diverting walls being inclined toward each other at substantially equal and opposite angles relative to the slope direction, so that they meet at a common uphill edge, and the method can further include causing the diverting wedge to allow some mud from a mudslide to pass through the fourth plurality of holes and continue to the barrier wall, while diverting a remainder of mud and debris of the mudslide to either side of the barrier wall.

A third general aspect of the present invention is a method of reducing erosion due to mudslides on a slope having a slope direction that is inclined at a slope inclination angle. The method includes installing a plurality of barrier structures on the slope, the plurality of barrier structures comprising at least one uphill barrier structure that is uphill of at least one downhill barrier structure, each of the uphill and downhill barrier structures being barrier structures according to any embodiment of the first general aspect. The method further includes allowing mud from a mudslide to impact the uphill barrier structure such that a first portion of the mud enters the chamber space of the uphill barrier structure while a second portion of the mud passes over, around, or through the uphill barrier structure, and allowing the second portion of the mud to impact the downhill barrier structure.

In embodiments, the uphill barrier structure includes at least one of an open passage that penetrates through the barrier apparatus of the uphill barrier structure and is configured to allow at least some of the second portion of the mud to proceed past the uphill barrier apparatus substantially unimpeded by the uphill barrier apparatus, and a diverting wedge extending uphill from the barrier wall of the uphill barrier structure, the diverting wedge comprising a pair of diverting walls that are penetrated by a fourth plurality of holes, the diverting walls being inclined toward each other at substantially equal and opposite angles relative to the slope direction so that they meet at a common uphill edge, the diverting wedge being configured to allow the first portion of the mud to pass through the fourth plurality of holes and continue to the barrier wall, while diverting at least part of the second portion of the mud to either side of the barrier wall.

In any of the above embodiments, the downhill barrier structure can include neither of an open passage and a diverting wedge.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DETAILED DESCRIPTION

The present invention is a barrier structure and method of use thereof for mitigating soil erosion caused by mudslides, where the barrier structure is relatively light in weight, easy and inexpensive to transport and install, and easy to remove and relocate after natural regrowth of vegetation has broken through the hydrophobic layer, stabilized the soil, and reduced the likelihood of future mudslides.

Rather than providing a barrier having an intrinsically high mass, such as a concrete barrier or large log, the present invention is configured to be initially light in weight, and to naturally increase its effective weight after installation by accumulating soil and/or water within its interior, so that the mass of the accumulated soil and/or water stabilizes the barrier structure and enables it to resist the oncoming force of a mudslide. Once the barrier structure is filled and stabilized, additional soil, debris and other materials accumulate in front of the barrier structure and function as an additional barrier that helps to mitigate and deflect the energy of mudslides. Accordingly, the disclosed barrier structure functions in a manner similar to a concrete barrier or log, but is far lighter in weight and easier to transport and remove.

The present invention is specifically configured for use on sloping ground, i.e. ground that is inclined at an angle of inclination from horizontal. The term "slope normal" is used herein to refer to a direction that is perpendicular to the sloping ground. Surfaces having inclinations that are greater than the inclination of the sloping ground are referred to herein as being "inclined downhill" while surfaces having inclinations that are less than the inclination of the sloping ground are referred to as being "inclined uphill." It should also be noted that the term "soil" is used herein generically to refer to all relatively small particulates, such as particles of sand and organic matter, that are suspended within and carried by water in a mudslide, while the term "debris" is used herein generically to refer to any relatively large objects, such as brush, tree branches, and rocks, that may also be propelled downhill by a mudslide.

Figure 1:
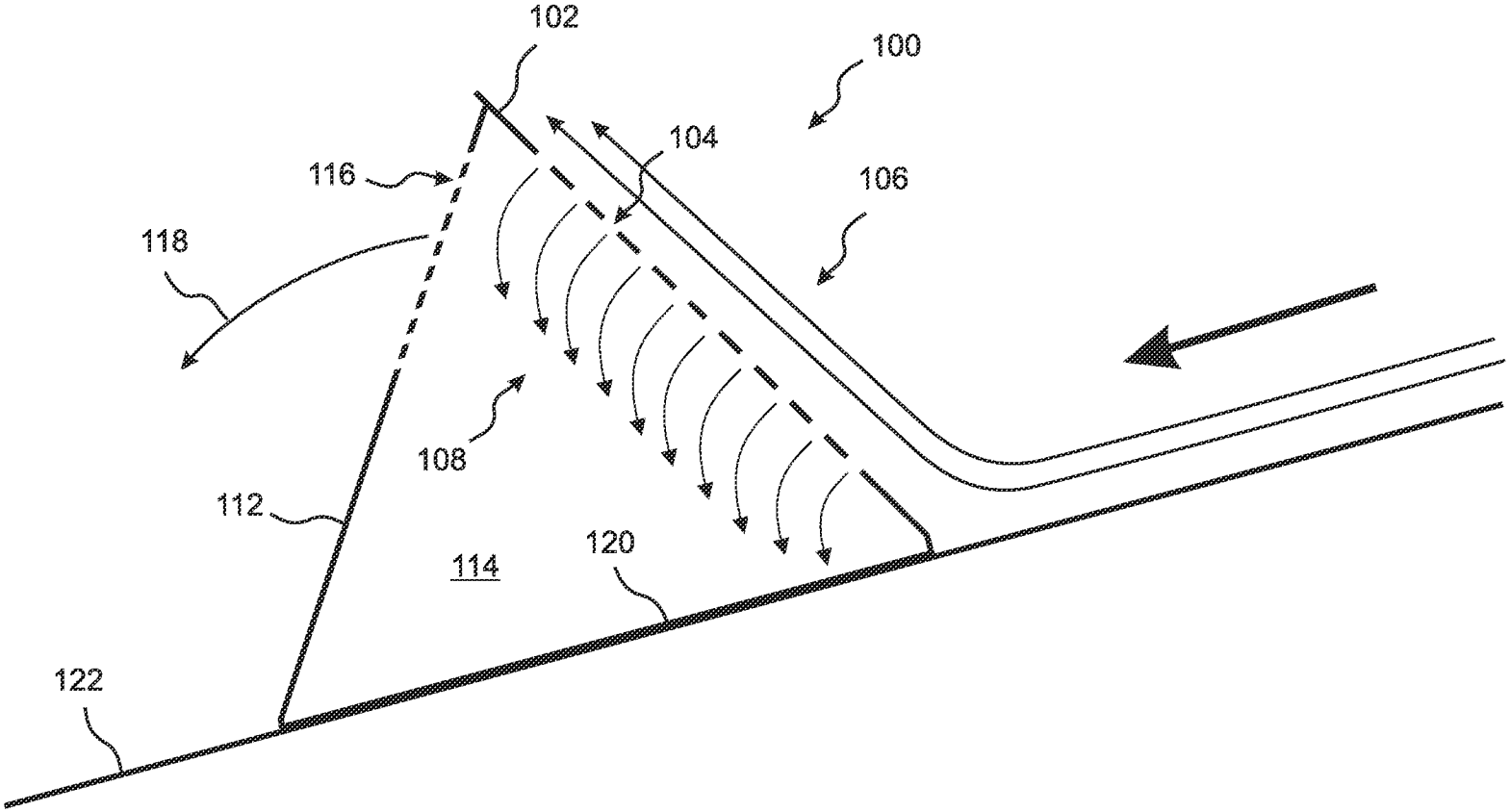
FIG. 1 is a cross-sectional view of a barrier apparatus according to an embodiment of the present invention that is removably attached to an underlying water reservoir.

With reference to FIG. 1, The disclosed barrier structure includes a barrier apparatus 100 comprising a rigid or semi-rigid, uphill facing barrier wall 102 that is penetrated by a plurality of "large" holes 104, which are typically between one half inch and 6 inches in diameter. The barrier wall 102 is inclined in a downhill direction, in embodiments by an angle of at least 20 degrees from the slope normal. In the embodiment of FIG. 1, the barrier wall 102 is inclined at an angle of 30 degrees from the slope normal. When a mudslide 106 impacts the barrier apparatus 100, it is directed upward across the front surface of the barrier wall 102, causing at least some of the mud 108 to enter through the large holes 104 into an interior 114 of the barrier apparatus 100 behind the barrier wall 102.

The barrier apparatus 100 further comprises a rear wall 112 and, in embodiments, also one or two side walls (812 in FIG. 8), which create a semi- or fully enclosed interior chamber 114 within which the mud that enters through the large holes forms a pool that allows the entrained soil to settle out of the water. "Small" holes 116 are provided in the rear wall 112 and, in embodiments, in at least one side wall 812, so that water within the interior that has separated from initially entrained soil can slowly drain out 118 of the interior chamber 114 and continue downhill. These "small" holes are smaller than the "large" holes 102, and are typically less than one half inch in diameter. In embodiments the small holes are included in a section of metal or plastic screen that is installed in the rear wall and/or in one or more side walls 812. In the embodiment of FIG. 1, the small holes 116 are offset from the bottom panel 120 of the barrier apparatus, so as to encourage pooling of the water and settling of the soil before the water drains through the small holes 116. In various embodiments, this offset is between two inches and one foot.

It should be noted that, while most embodiments of the present invention are intended for installation on sloping ground, for ease of illustration the remaining figures presented herein after FIG. 1 illustrate embodiments as they would appear when installed on flat ground.

Figure 2:
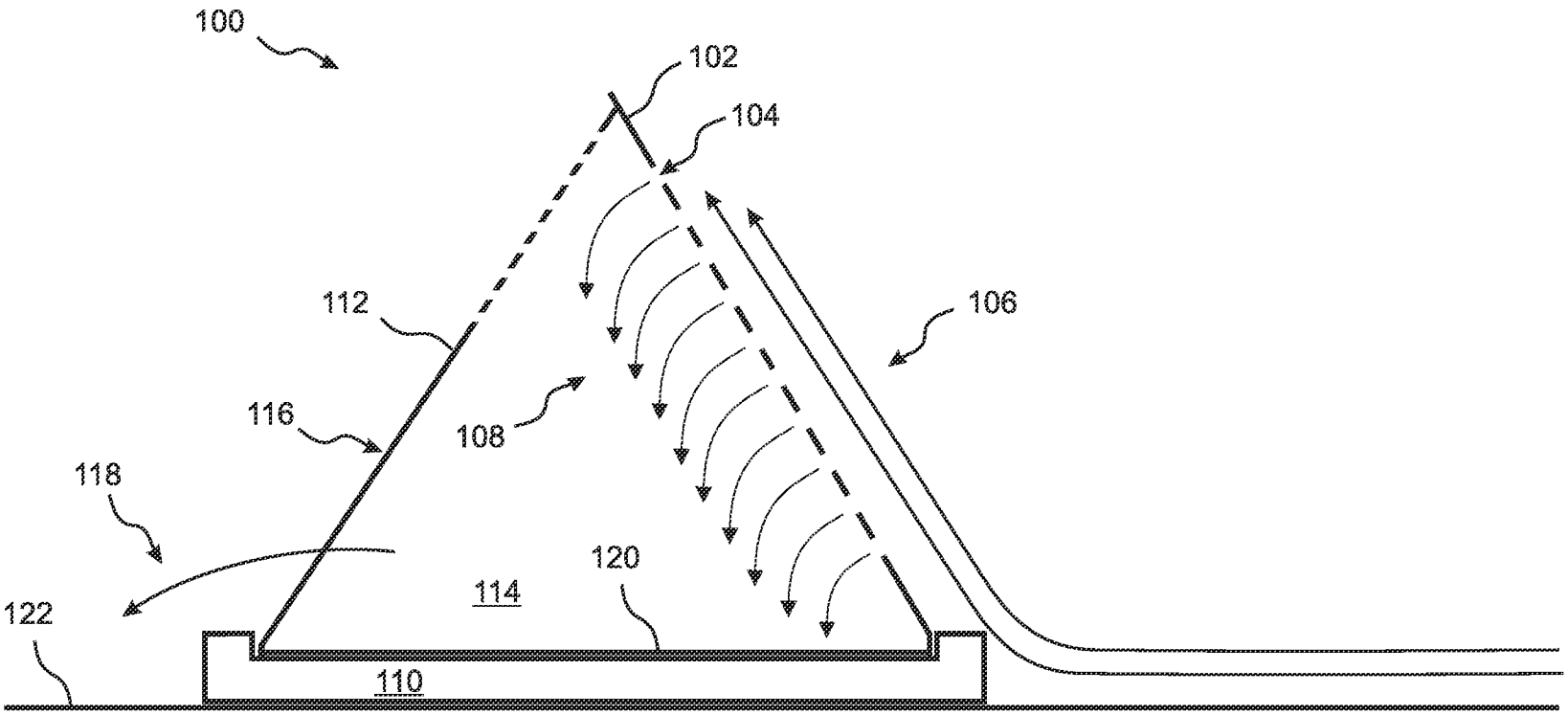
FIG. 2 is a cross-sectional view of a barrier apparatus installed on an inflatable base.
Figure 3A:
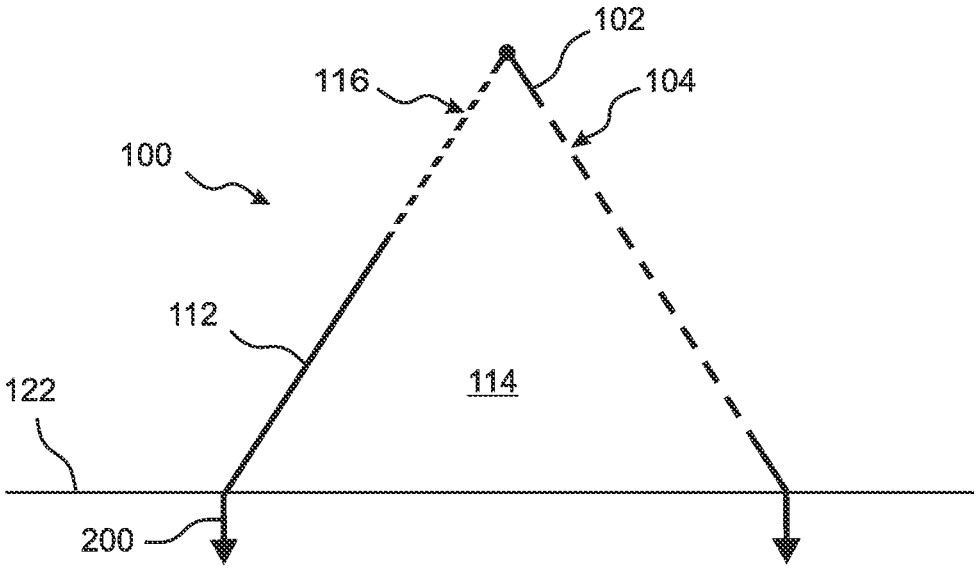
FIG. 3A is a cross-sectional view of a barrier apparatus according to the present invention that is held in place by anchoring stakes.

Some embodiments are sufficiently heavy and sturdy to withstand the impact of mudslides and to remain in position without anchoring, while other embodiments include an anchoring feature. The embodiment of FIG. 2 includes a base 110 that is water-inflatable, so as to further reduces the cost and difficulty of installing and removing the apparatus. As an alternative, the embodiment of FIG. 3A includes anchor stakes 200 that can be driven into the ground beneath the barrier apparatus 100.

Figure 3B:
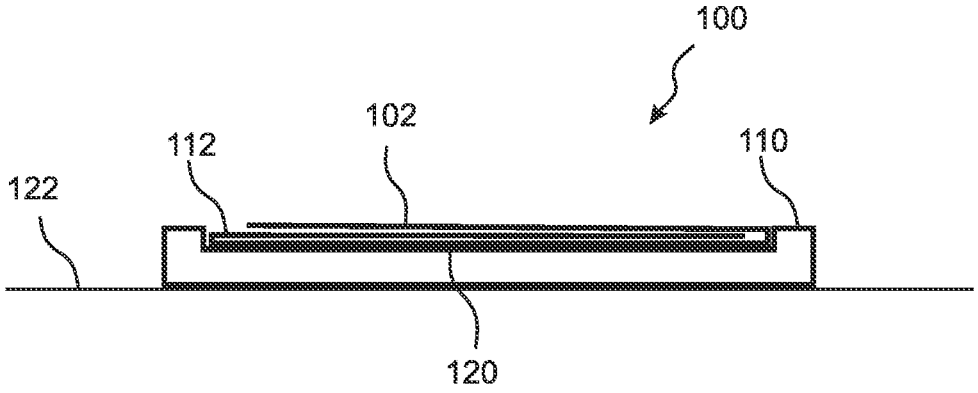
FIG. 3B is a cross-sectional view of the barrier apparatus of FIG. 2, shown in a folded configuration.

Certain embodiments can be easily disassembled and/or folded for transport and for storage. With reference to FIG. 3B, the embodiment of FIG. 2 can be folded during transit, and then erected when it arrives at the installation site.

Figure 4:
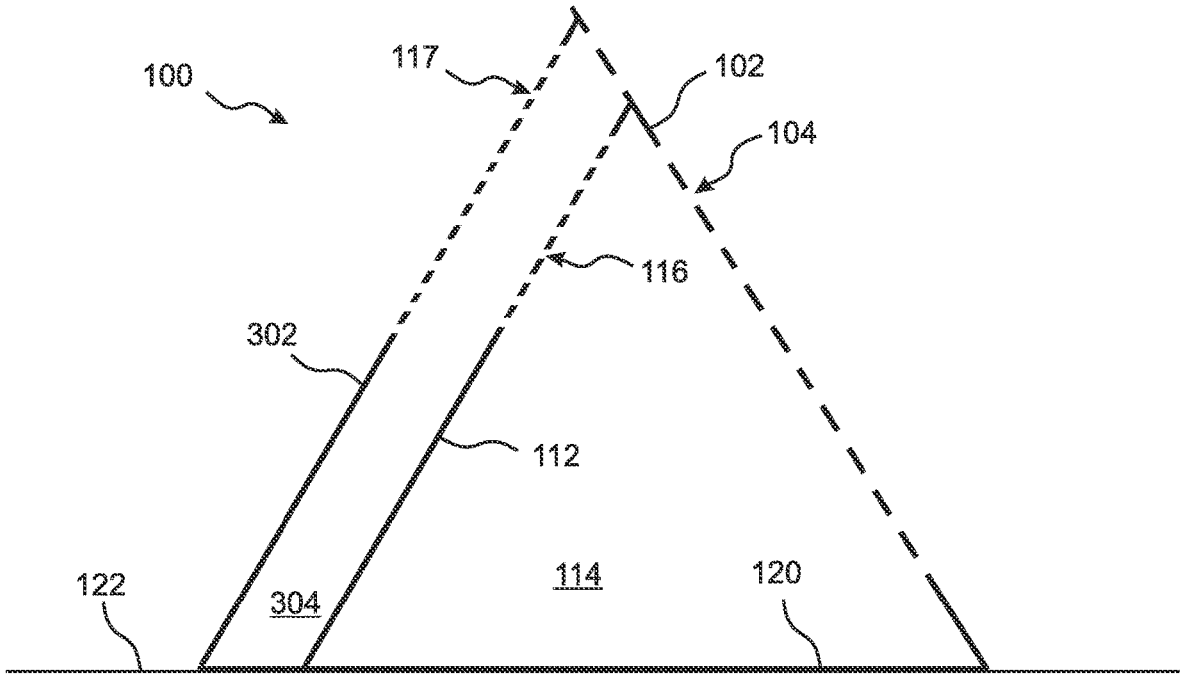
FIG. 4 is a cross-sectional view of a barrier apparatus in an embodiment that further includes a backstop wall.

In the embodiment of FIG. 4, the barrier wall 102 extends above the top of the rear wall 112, and a backstop wall 302 extends from behind the bottom of the rear wall 112 to a height on the barrier wall 102 that is above the top of the rear wall 112, so that an additional barrier chamber 304 is formed between the backstop wall 302 and the rear wall 112. Additional backstop holes 117 are provided in the upper portion of the backstop wall 302.

Figure 5A:
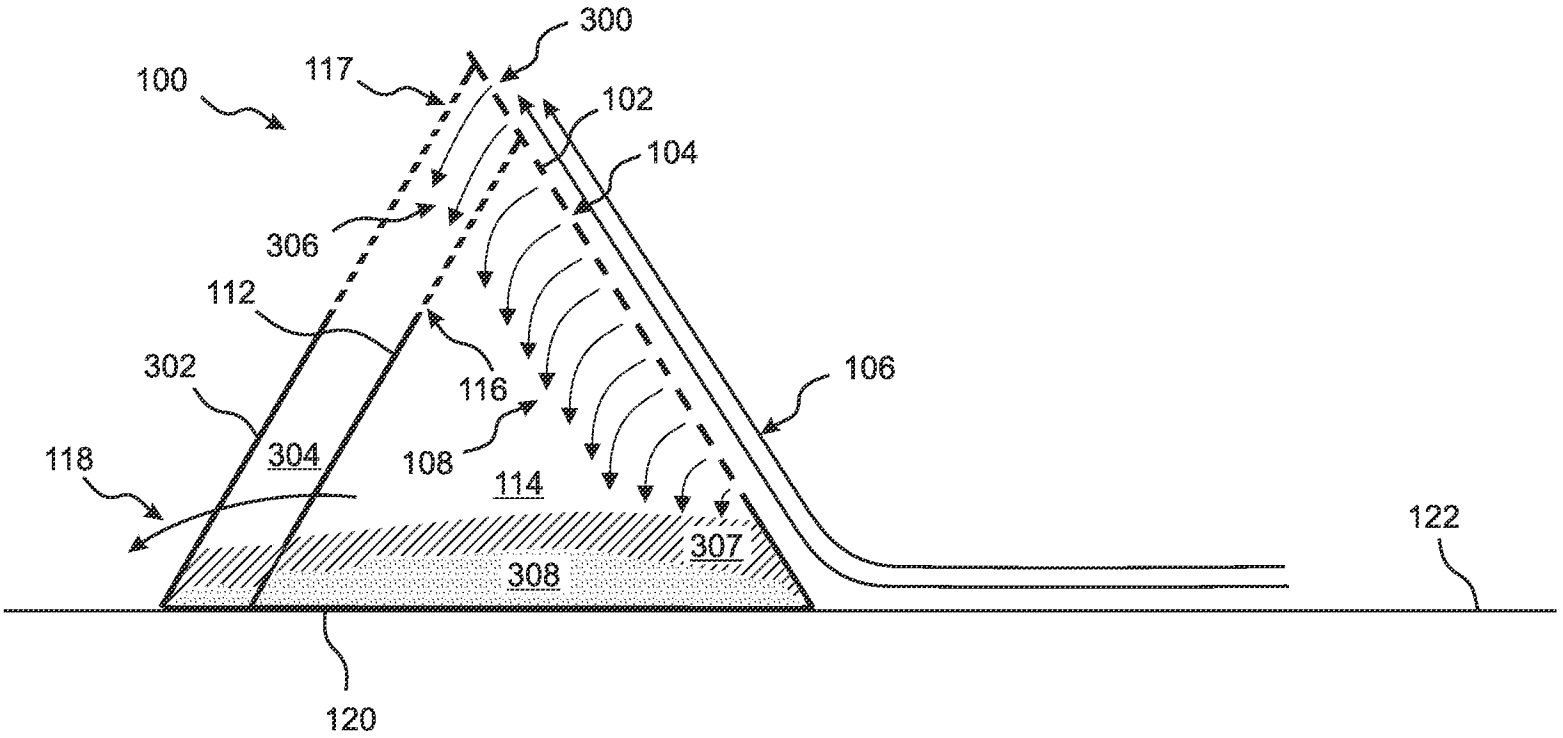
FIG. 5A is a cross-sectional view of the barrier apparatus of FIG. 4 interacting with flowing mud.

FIG. 5A illustrates the interaction between the barrier apparatus 100 of FIG. 4 and mud 106 flowing toward the barrier apparatus 100. As the mud 106 flows up the barrier wall 102 carrying entrained soil, some of the mud 108 flows through the large holes 104 and into the interior chamber 114 of the barrier apparatus, where it forms a pool 306 that allows the entrained soil 308 to separate from the water 307. Additional large holes 300 are provided in the upper portion of the barrier wall 102, allowing more mud 306 to flow into the additional chamber 304 formed between the backstop wall 302 and the rear wall 112, where the mud pools and allows entrained soil 308 to settle. The water 307 then slowly drains out of the interior chambers 114, 304 through the small holes 116, 117 provided in the rear wall 112 and backstop wall 302.

Figure 5B:
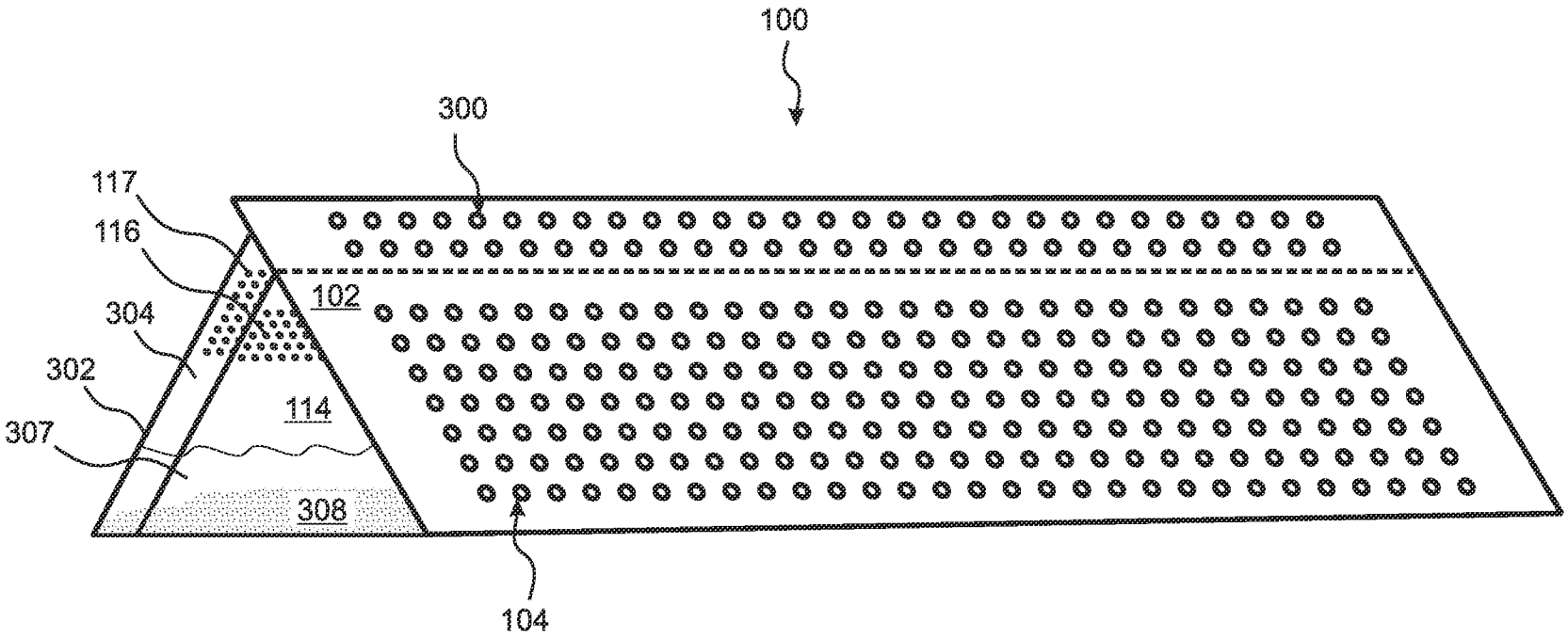
FIG. 5B is a front-left perspective view of the barrier apparatus of FIG. 4.

A front-left perspective view of the embodiment of FIG. 5A is presented in FIG. 5B, wherein the left side panel has been made transparent so that the interior structure is visible.

Embodiments of the disclosed apparatus are constructed from panels 102, 112, 120 any or all of which can range in thickness between one quarter of an inch and two inches in thickness. In some embodiments, any or all of the panels 102, 112, 120 are between one quarter of an inch and one inch in thickness. In other embodiments, any or all of the panels 102, 112, 120 are between 1/32 inch and 12 inches thick.

In various embodiments, any or all of the panels 102, 112, 120 are sheets made from plywood, from metal, from a plastic such as acrylic, from fiberglass, from particle board, which may include a laminated coating or veneer, from micro-lattice, from rigid foam, from Styrofoam, from graphene, and/or from some other suitable material. Some embodiments are constructed using bio-degradable materials such as AshCrete, hemperete clay, Timbercrete, bamboo, recycled wood, and other recycled materials, so that it is no necessary to remove the barriers after the danger of mudslides has abated. Some embodiments include a bottom panel 120, while others do not.

Figure 6:
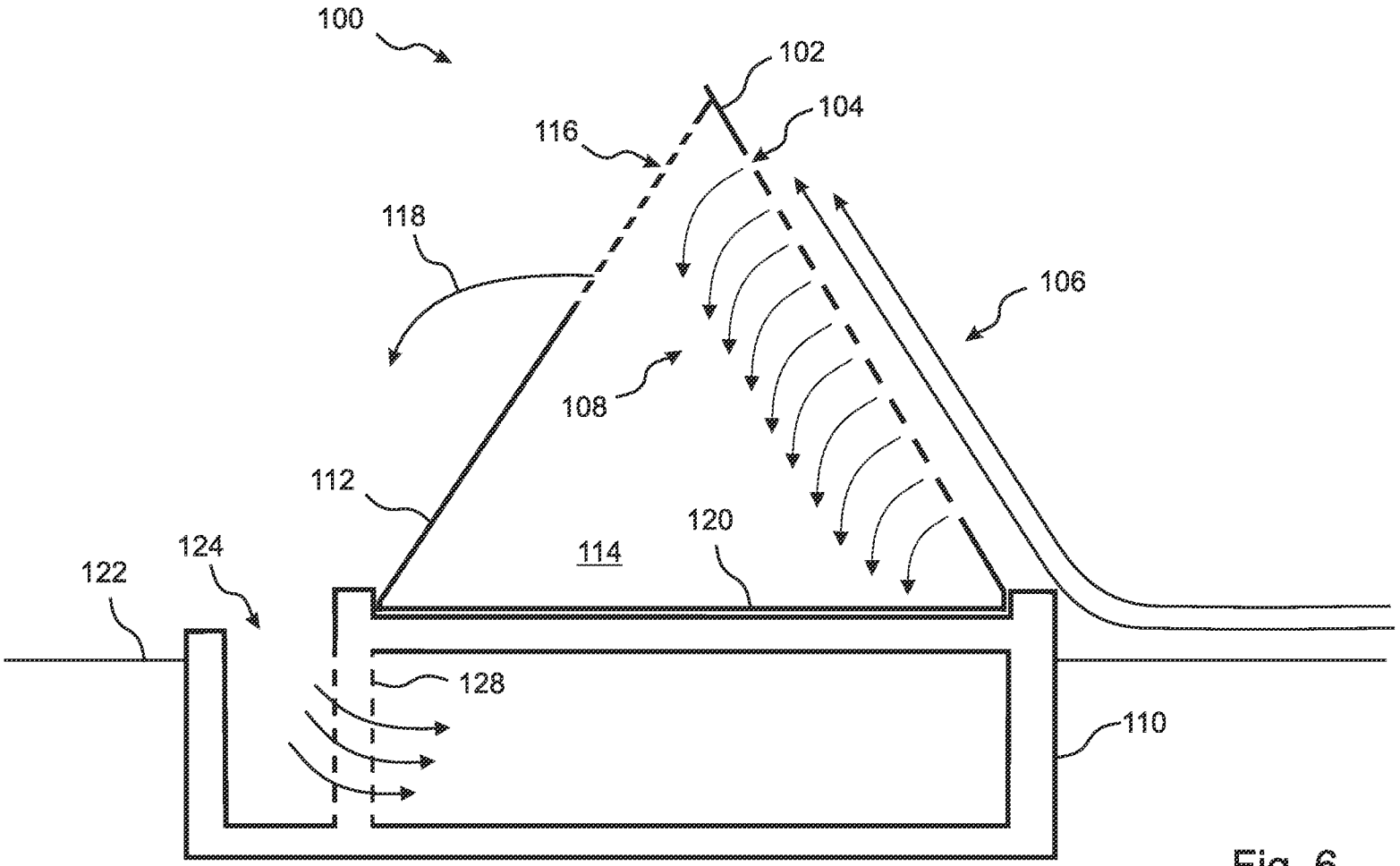
FIG. 6 is a cross-sectional view of a barrier apparatus that includes an underlying reservoir configured to be buried below ground, shown interacting with flowing mud.

With reference to FIG. 6, in embodiments the barrier apparatus 100 further includes an underlying water reservoir 110 that is configured to fill with water, for example rapidly during a heavy rain that precedes a mudslide, or more slowly as water drains of the small holes 116 after a mudslide. The underlying reservoir is further configured to collect and contain mud when mud from a mudslide flows over the top of the barrier wall 102. The acquired weight of the underlying reservoir 110 thereby helping to maintain the barrier apparatus 100 in place when future mudslides impact the barrier apparatus 100. In the illustrated embodiment, the underlying reservoir 110 extends behind the rear wall 112 of the barrier apparatus 100, and includes an open region 124 that is positioned to receive mud 106 as it flows over the top of the barrier wall 102 as well as water 118 as it flows out of the barrier apparatus interior 141 through the small holes 116. In the embodiment of FIG. 6, the open region 124 is separated from the remainder of the underlying water reservoir 110 by a perforated wall 128 that provides enhanced support and rigidity. In similar embodiments, the perforated wall 128 of the underlying water reservoir 110 is omitted.

In the embodiment of FIG. 6, the overlying elements of the barrier apparatus 100 are attachable to and detachable from the underlying water reservoir 110. In other embodiments, the underlying water reservoir 110 is inseparable from the remainder of the barrier apparatus 100.

Figure 7:
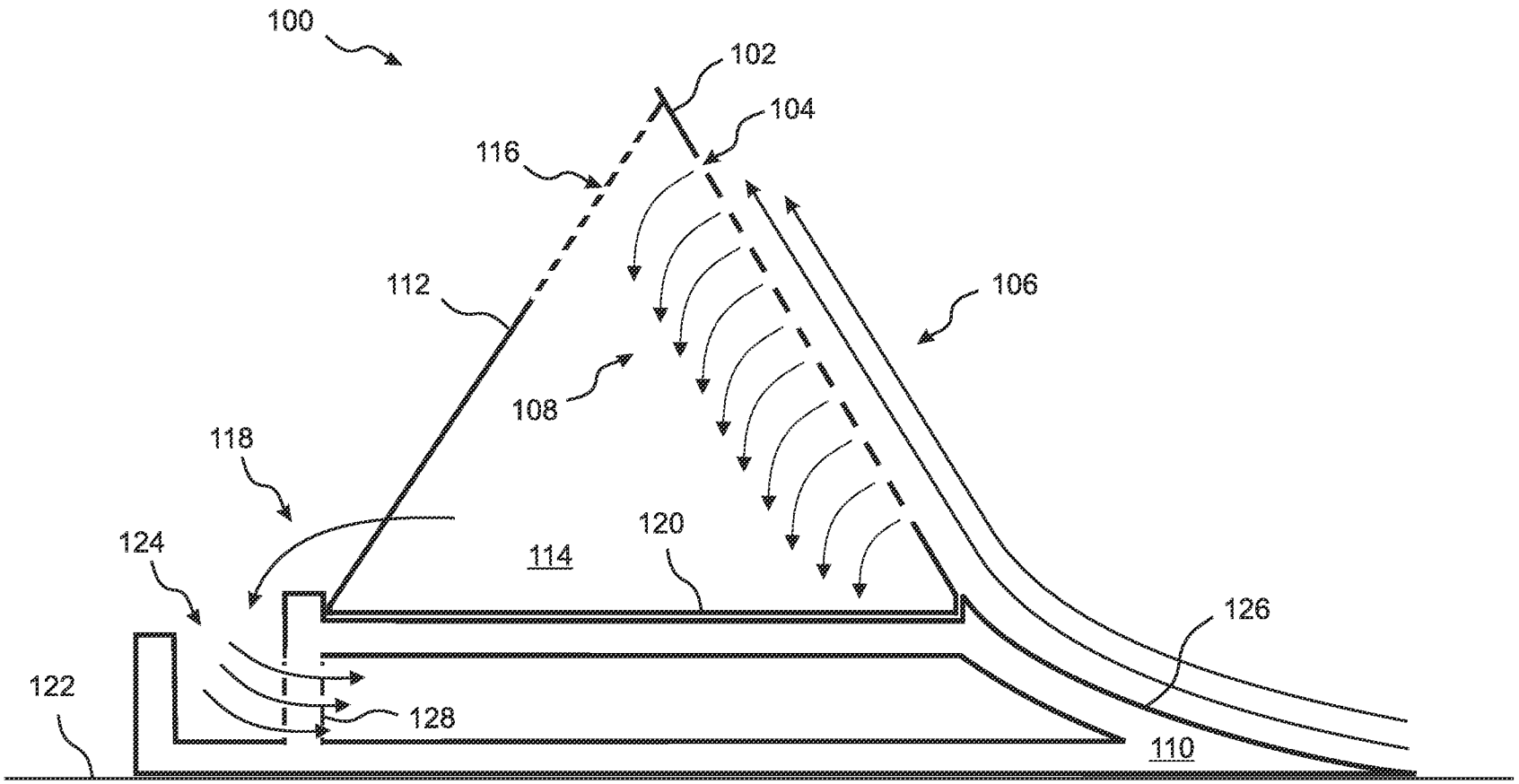
FIG. 7 is a cross-sectional view of an embodiment similar to FIG. 6, but wherein the underlying water reservoir is configured for placement on top of the ground.

In the embodiment of FIG. 6, the underlying water reservoir 110 is configured for installation below the surface 122 of the ground, so that the remainder of the barrier apparatus 100 extends from the level of the soil 122 upward. In the embodiment of FIG. 7, the underlying water reservoir 110 is configured for placement onto the surface 122 of the ground. The underlying water reservoir 110 in the illustrated embodiment extends in front of the barrier wall 102 and includes a curved shape 126 that guides oncoming mud 106 up from the ground 122 to the large holes 104 of the barrier wall 102.

Figure 8:
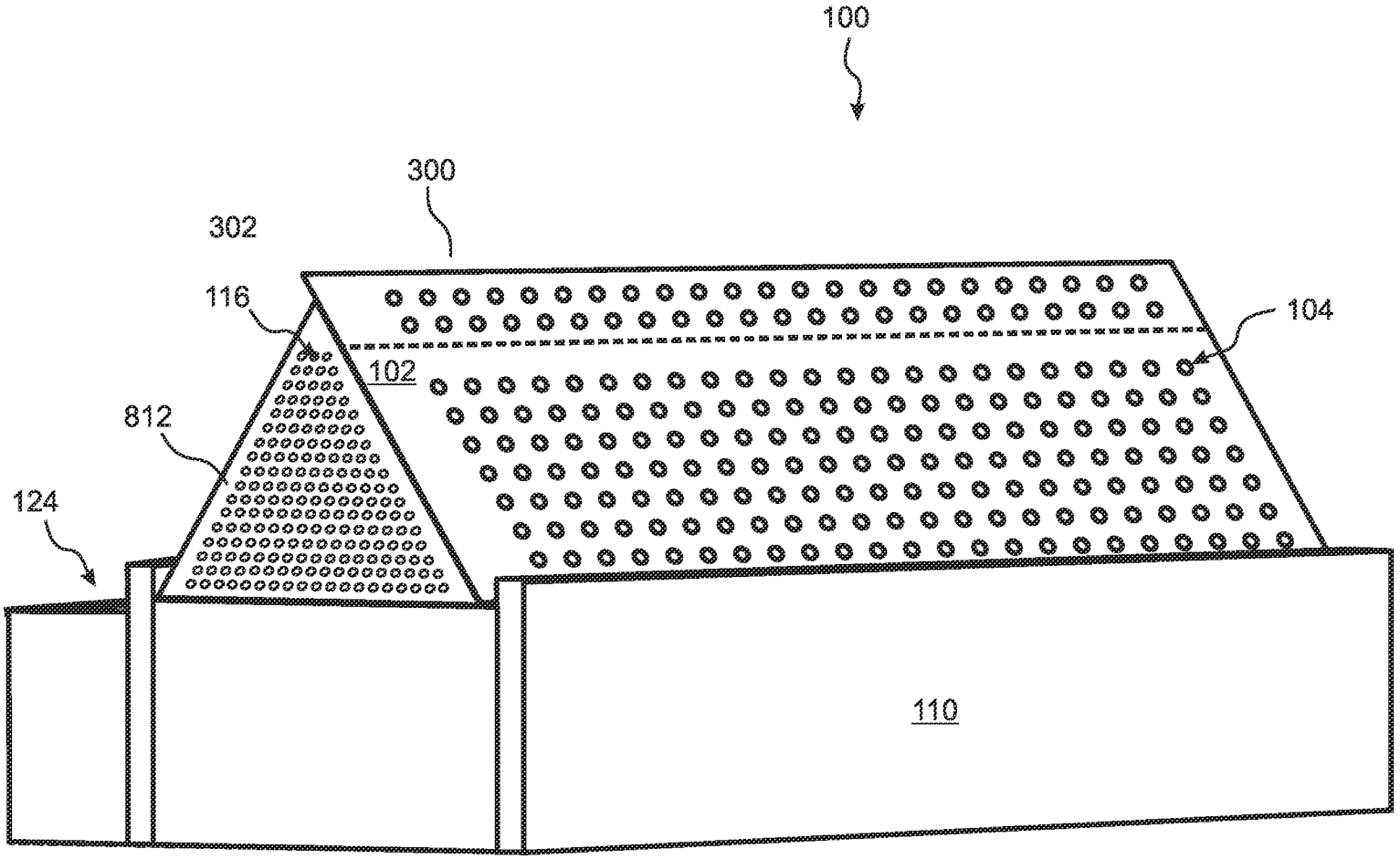
FIG. 8 is a perspective view of the embodiment of FIG. 6, shown with side panels included in the barrier apparatus.
Figure 9:
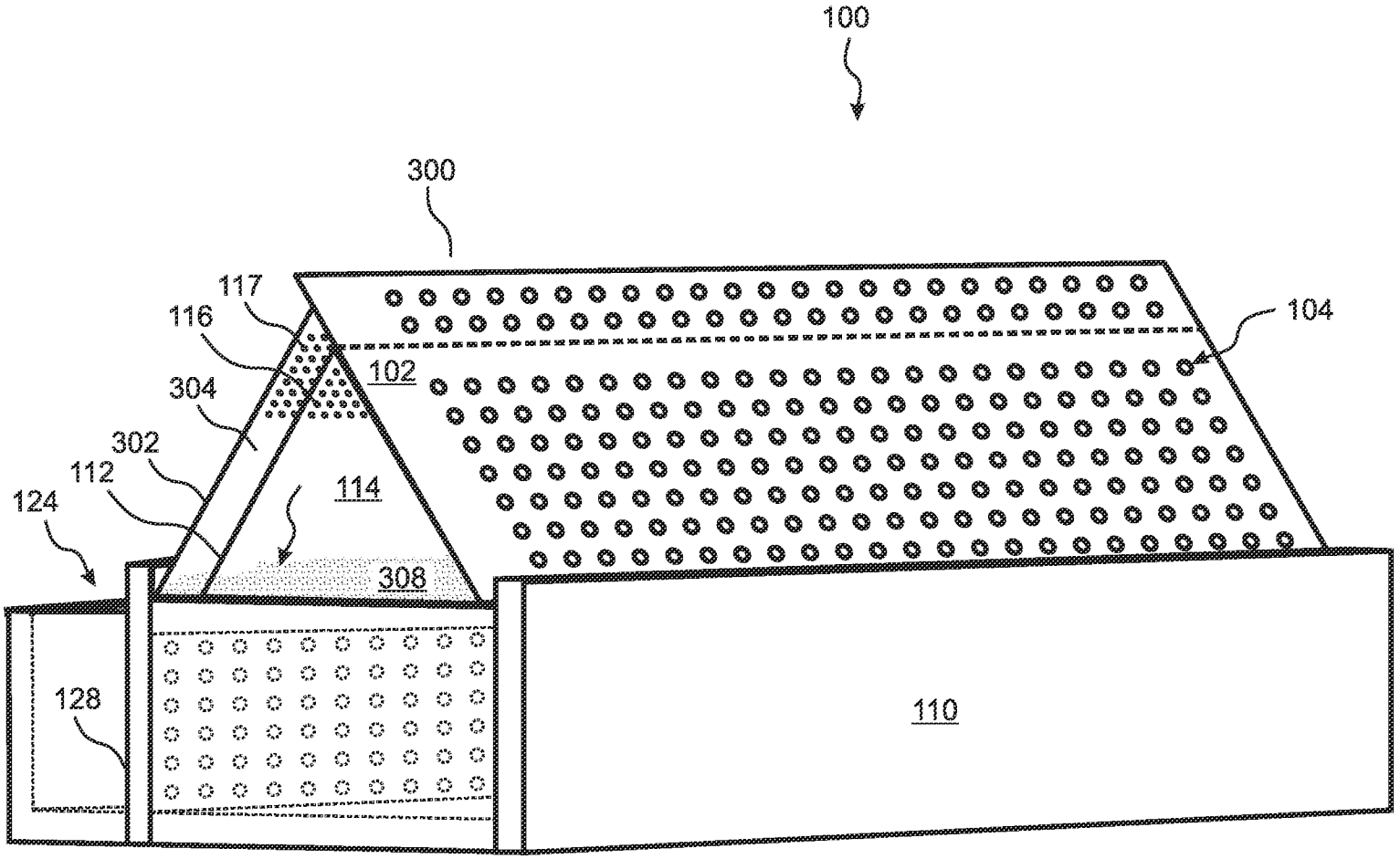
FIG. 9 is a view similar to FIG. 8, with the left side walls of the barrier apparatus and underlying reservoir rendered transparent so that interior structures can be seen.

A front-left perspective view of the embodiment of FIG. 6 is presented in FIG. 8, where the embodiment includes side panels 812 that are penetrated by additional small holes 116. A similar view is presented in FIG. 9, where the left side panel 812 has been made transparent, so that the interior structure is visible.

Figure 10:
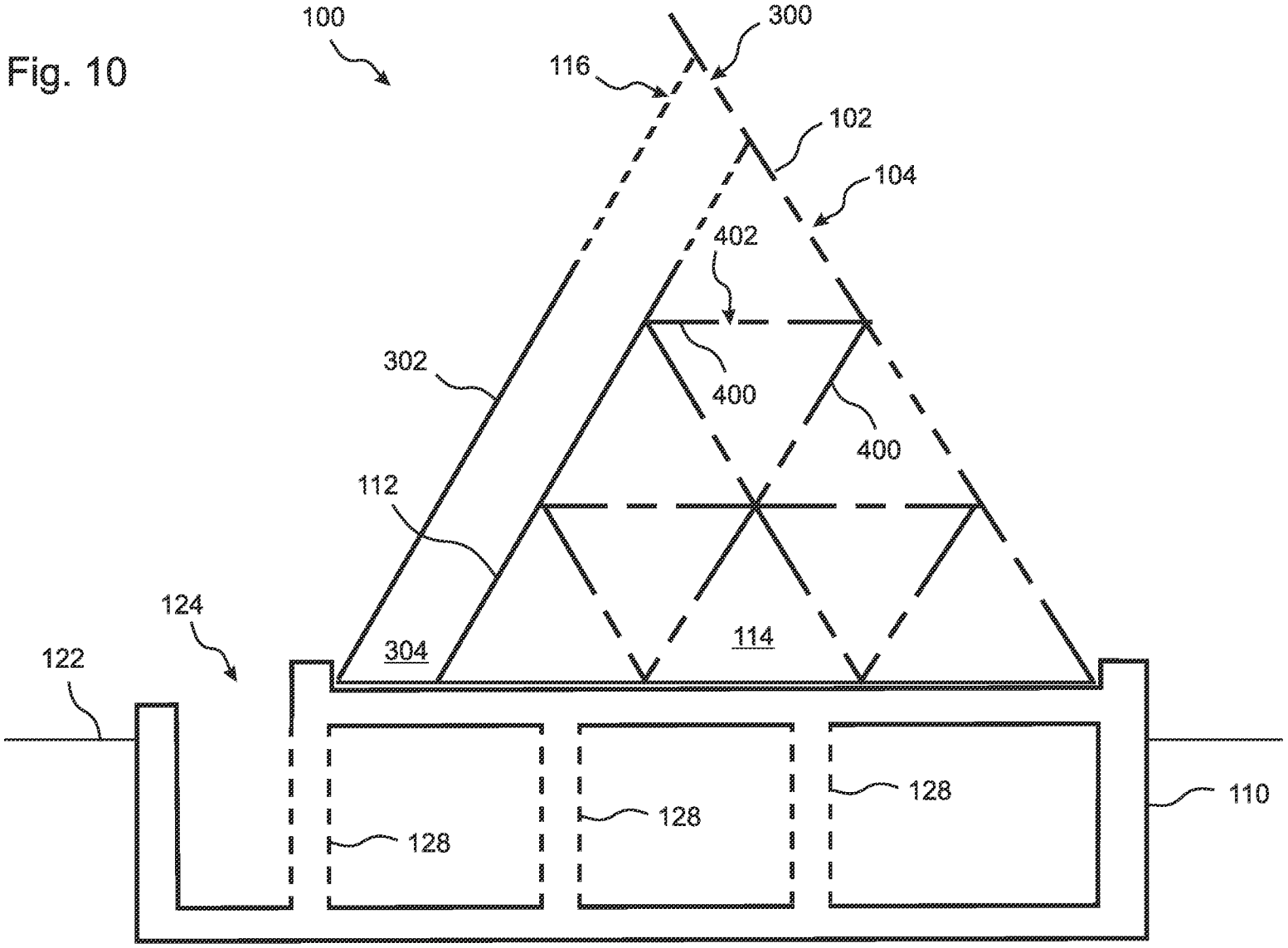
FIG. 10 is a cross-sectional view of the barrier apparatus in an embodiment similar to FIG. 7, but including structure-enhancing internal panels within its interior.

With reference to FIG. 10, some embodiments that require enhanced structural strength include internal partition walls 400 that extend between and reinforce the barrier wall 102 and rear wall 112. The partition walls 400 are penetrated by additional, interior large holes 402, so that mud that enters through the large holes 104 in the barrier wall 102 is able to flow downward through the interior large holes 402 to the bottom 120 of the barrier apparatus interior chamber 114. The embodiment of FIG. 10 also includes additional perforated walls 128 within the underlying water reservoir 110 that further enhance the structural strength.

Figure 11:
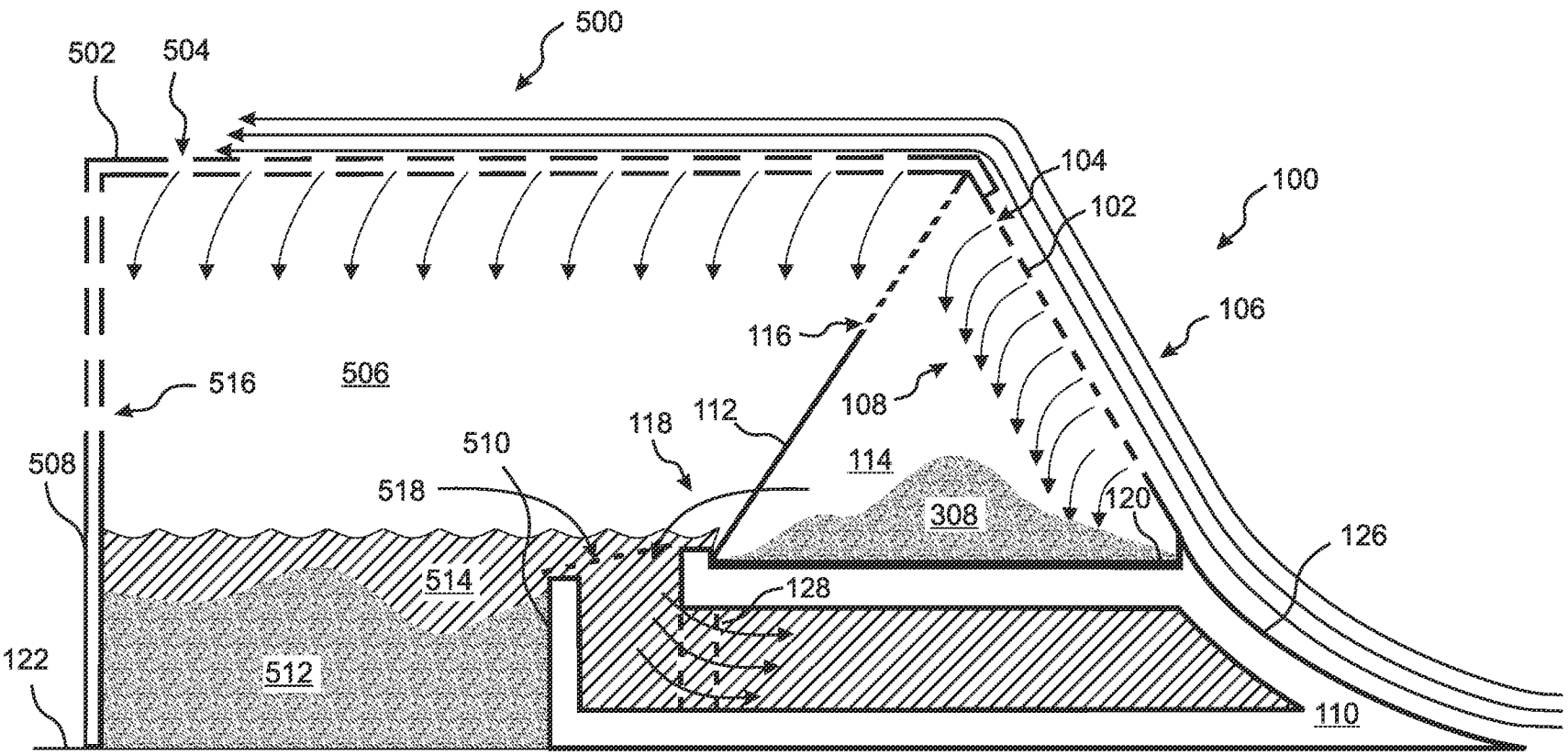
FIG. 11 is a cross-sectional illustration of a barrier extension attached to a barrier apparatus according to an embodiment of the present invention.

With reference to FIG. 11, in some embodiments the barrier structure further includes a barrier extension 500 that can be removably coupled to the barrier apparatus 100 and underlying water reservoir 110 (if present). The barrier extension 500 includes a top 502 that is penetrated by extension holes 504, which in embodiments are larger than the "large" holes 104 of the barrier apparatus 100. When attached to the barrier apparatus 100, the top 502 of the barrier extension 500 is substantially parallel with the underlying ground 122, and extends to the upper edge of the barrier wall 102, so that mud 106 that flows over the top of the barrier wall 102 is caused to flow across the top 502 of the barrier extension 500, whereupon the mud falls through the extension holes 504 and into an interior 506 of the barrier extension 500. It will be noted that the barrier extension 500 is also referred to herein simply as the "extension."

The interior 506 of the barrier extension 500 in the embodiment of FIG. 11 is bounded by a rear wall 508 of the extension 500 and by two side panels (600 in FIG. 13) of the extension 500. The front of the extension 500 is open, so that the top 502 of the extension 500 can extend to the top edge of the barrier wall 102 of the barrier apparatus 100. When the extension 500 is attached to the barrier apparatus 100, the rear wall 510 of the underlying water reservoir 110 becomes the front boundary of the extension interior 506.

As mud falls through the extension holes 504 into the interior 506 of the extension 500, the entrained soil 512 settles and separates from the water 514. As the level of water 514 above the soil 512 rises, the water 514 is able to flow over the rear wall 510 of the underlying reservoir 110 through a screen 518 and into the underlying reservoir 110. In the embodiment of FIG. 11, the rear wall 508 of the extension 500 includes additional holes 516 that allow excess water to escape from the interior 506 of the extension 500 after the underlying reservoir 110 has been filled with water and/or soil.

Figure 12:
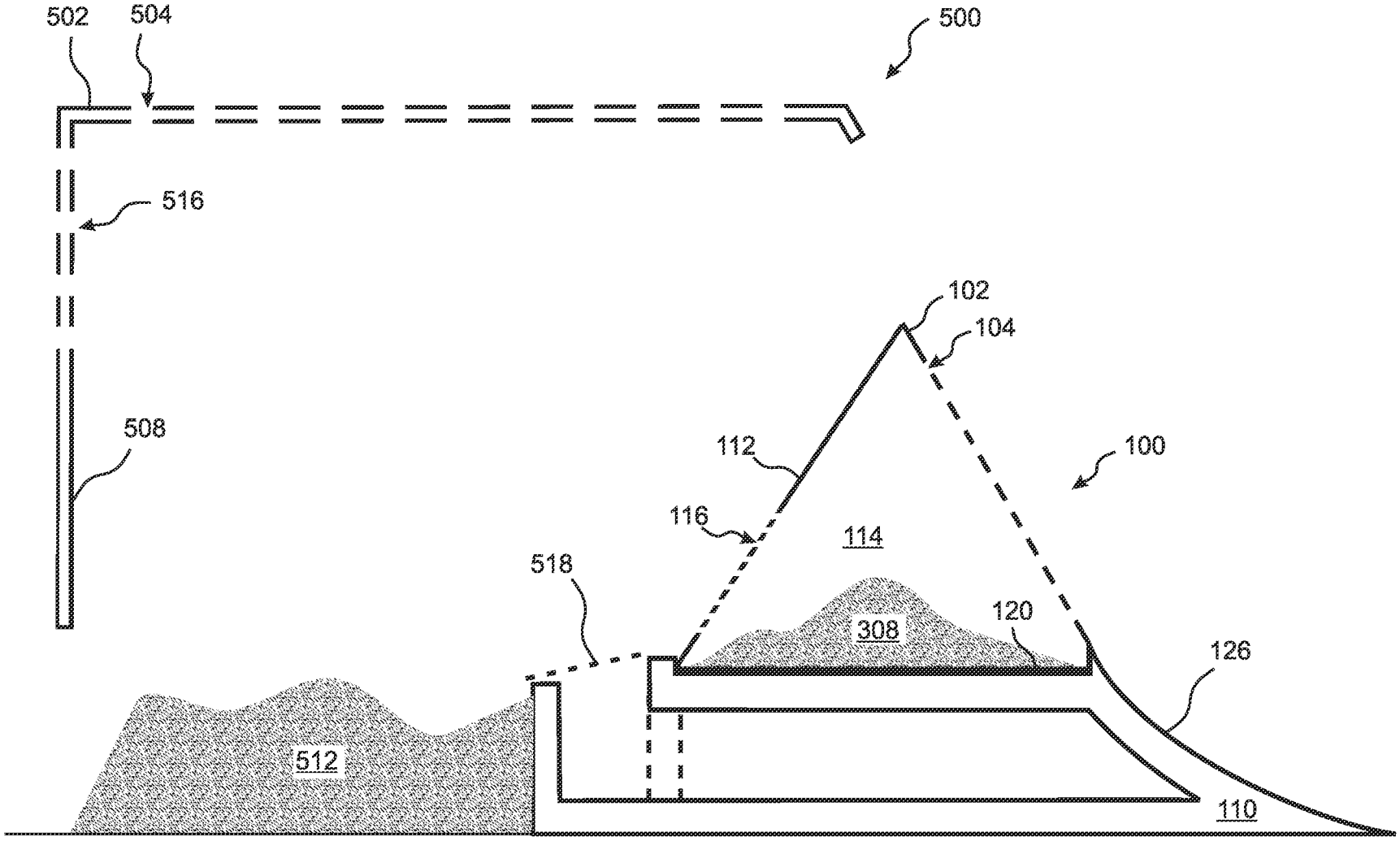
FIG. 12 is a cross-sectional illustration of the embodiment of FIG. 11, shown with the extension removed from the barrier apparatus.

In FIG. 12, the extension 500 has been removed after a mudslide, and is shown above and to the left of the barrier apparatus 100. The soil 512 that was collected during the storm within the interior 506 of the barrier extension 500 remains on the ground abutting the rear wall of the underlying reservoir 110. Together with the soil 308 that was collected within the interior chamber 114 of the barrier apparatus 100, the soil 512 collected in the extension further helps to stabilize the barrier apparatus 100 against future mudslides.

Figure 13:
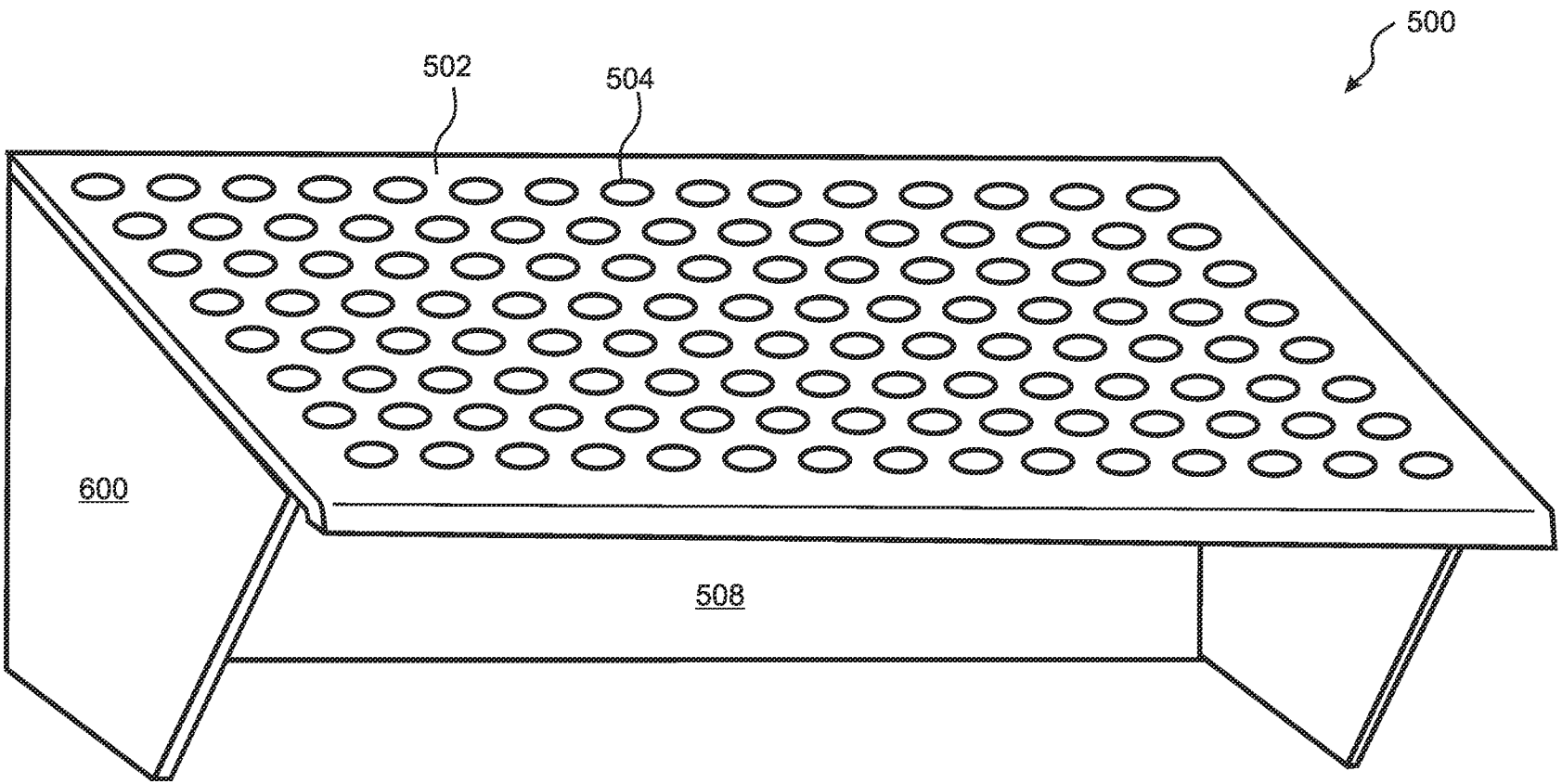
FIG. 13 is a perspective view of a barrier extension in an embodiment of the invention, shown without attachment thereof to a barrier apparatus.

It will be noted that FIGS. 11 and 12 are cross-sectional side views of the barrier apparatus 100 and the extension 500. FIG. 13 is a perspective view from above and to the left of a barrier extension 500 in an embodiment where the extension 500 includes side panels 600.

Figure 14:
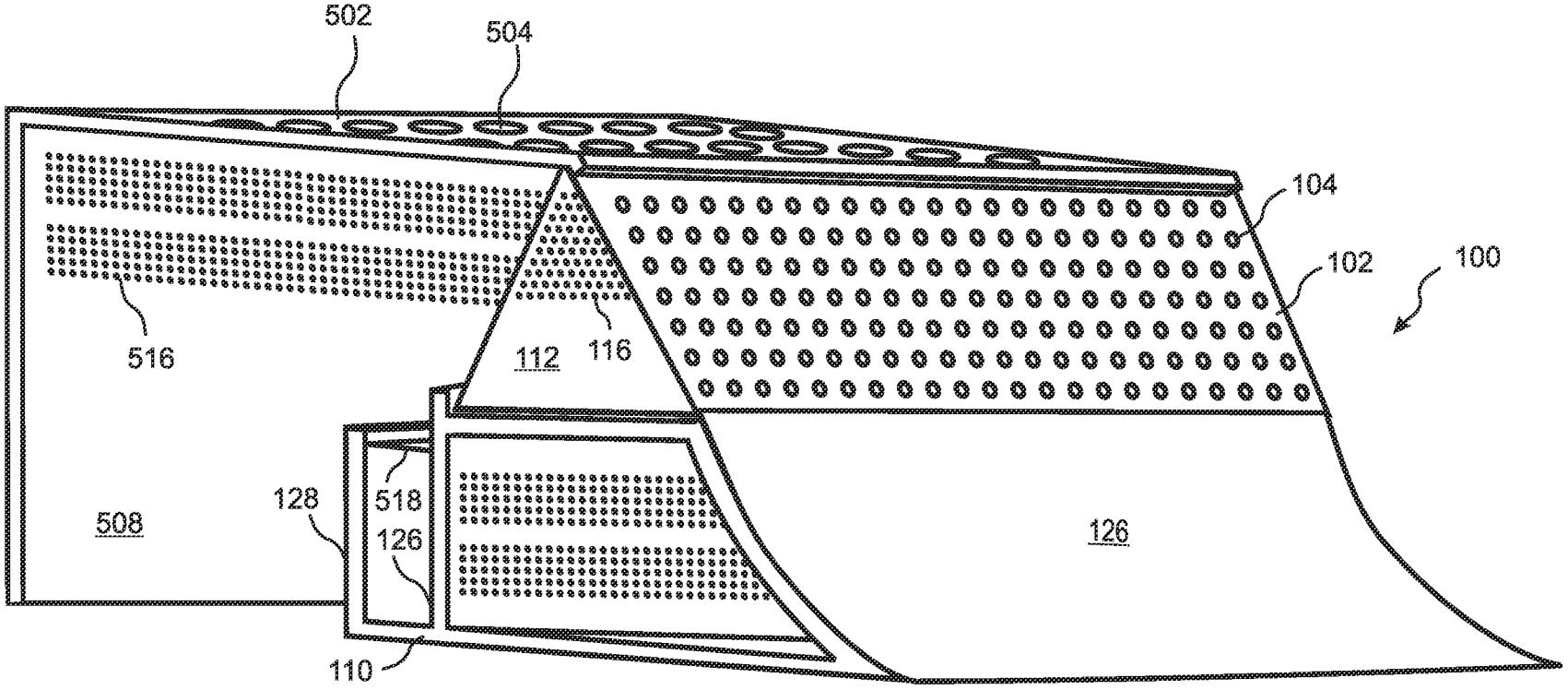
FIG. 14 is a perspective side view of the embodiment of FIG. 11, shown with the left side panels removed so as to reveal internal structure of the embodiment.
Figure 15:
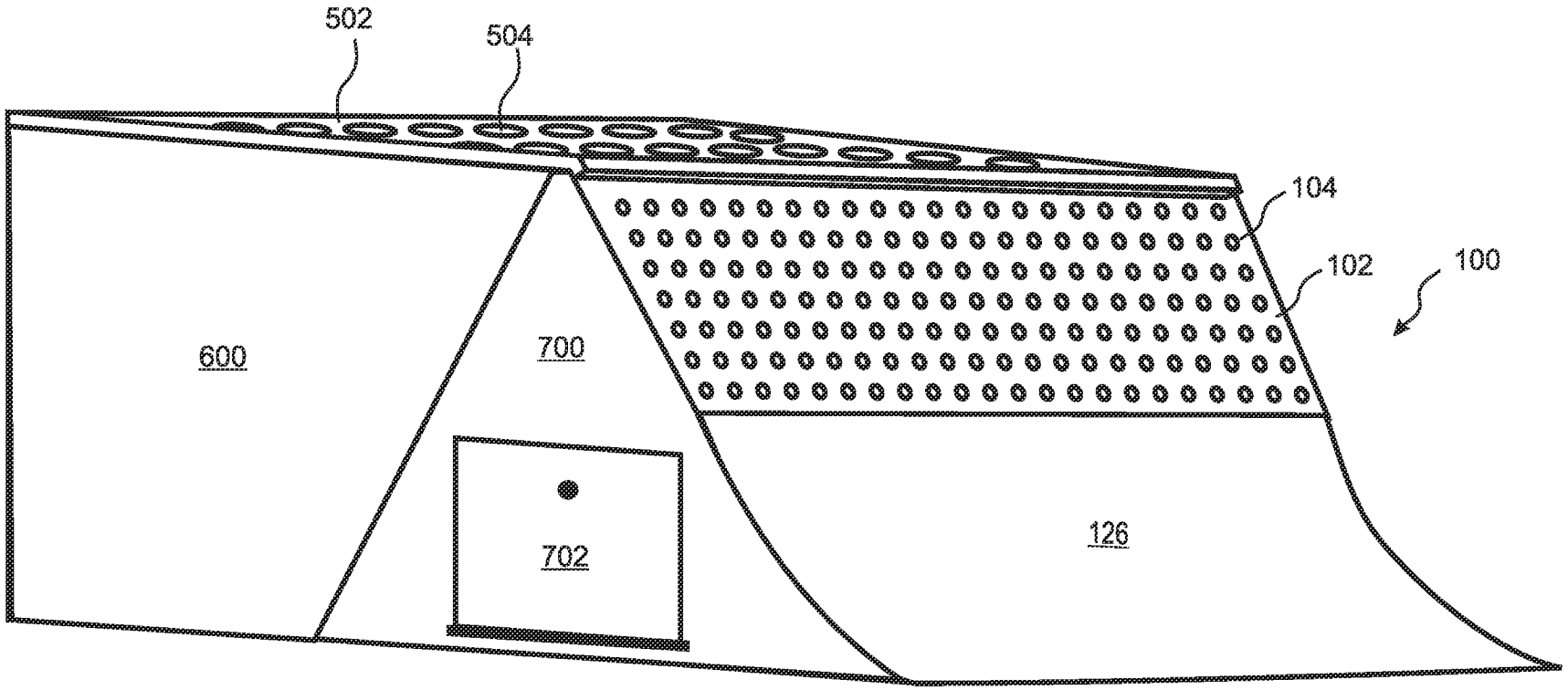
FIG. 15 is a perspective view of the embodiment of FIG. 14, shown with the side panels included.

FIG. 14 is a perspective view from above and from the left of a barrier apparatus 100 similar to FIG. 7 to which an extension 500 is attached. The side panels 600, 700 of the barrier apparatus 100 and of the extension 500 have been rendered transparent, so that the internal features of the barrier structure can be discerned. In FIG. 15, the same view is shown, but with the side panels 600, 700 included. It will be noted that in the illustrated embodiment, the side panel 700 of the barrier apparatus includes a water-releasing side door 702 that can be opened to allow retained water to escape from the underlying reservoir 110.

Figure 16:
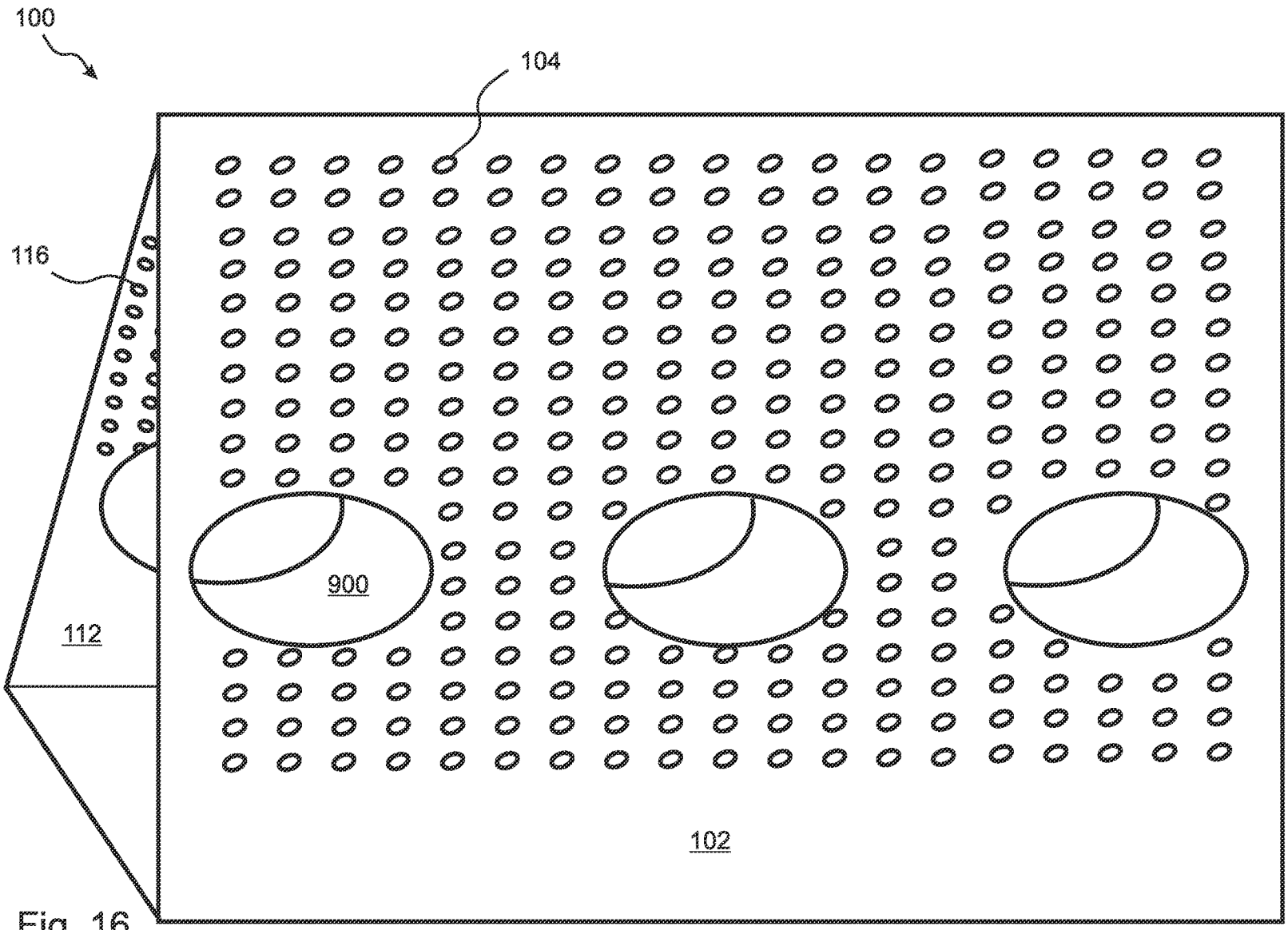
FIG. 16 is a perspective view of a barrier apparatus similar to FIG. 1 but including cylindrical passages that allow some impacting mud to pass through the barrier apparatus unimpeded.
Figure 17:
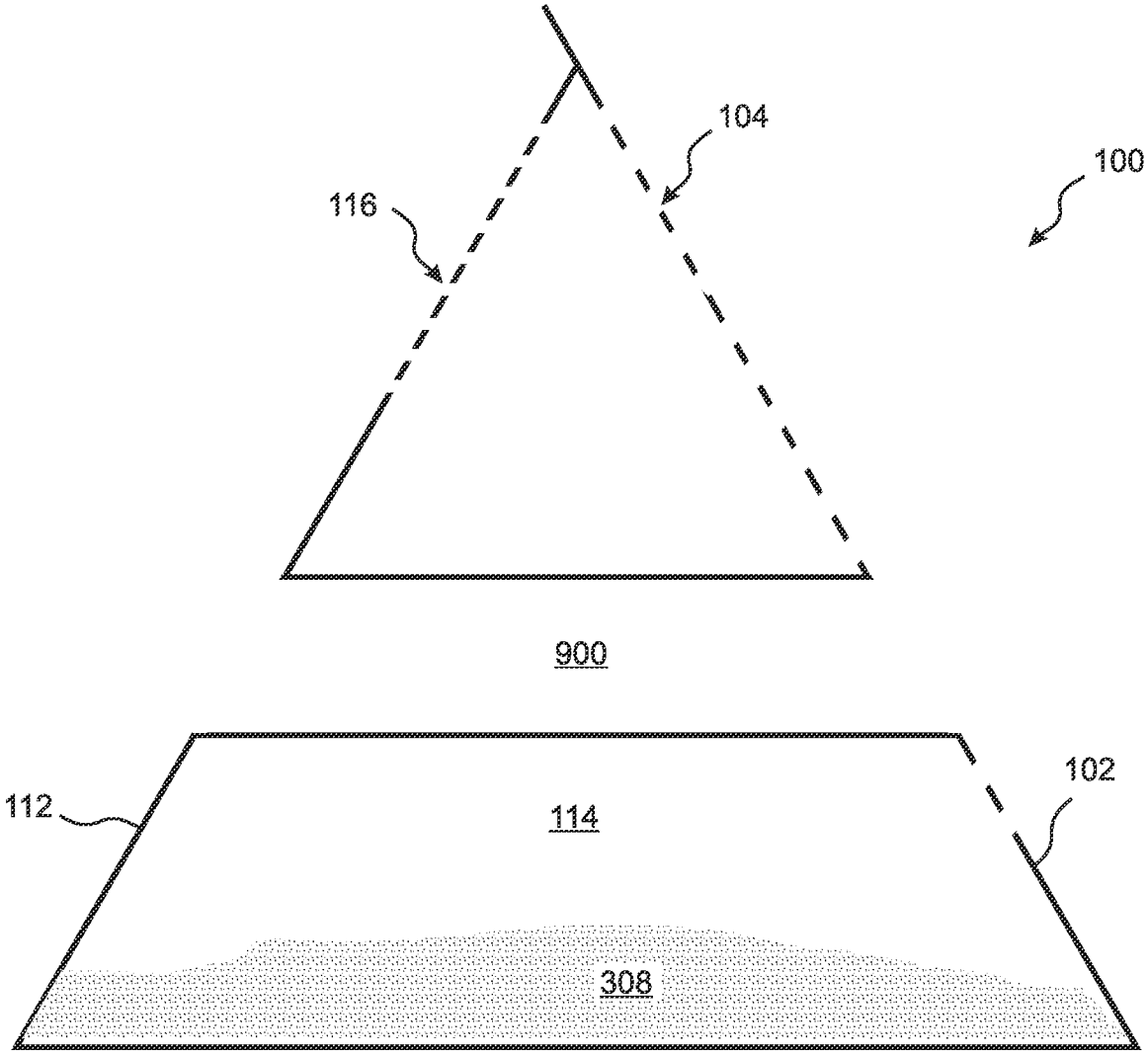
FIG. 17 is a cross-sectional side view of the embodiment of FIG. 16, taken through one of the passages.
Figure 18:
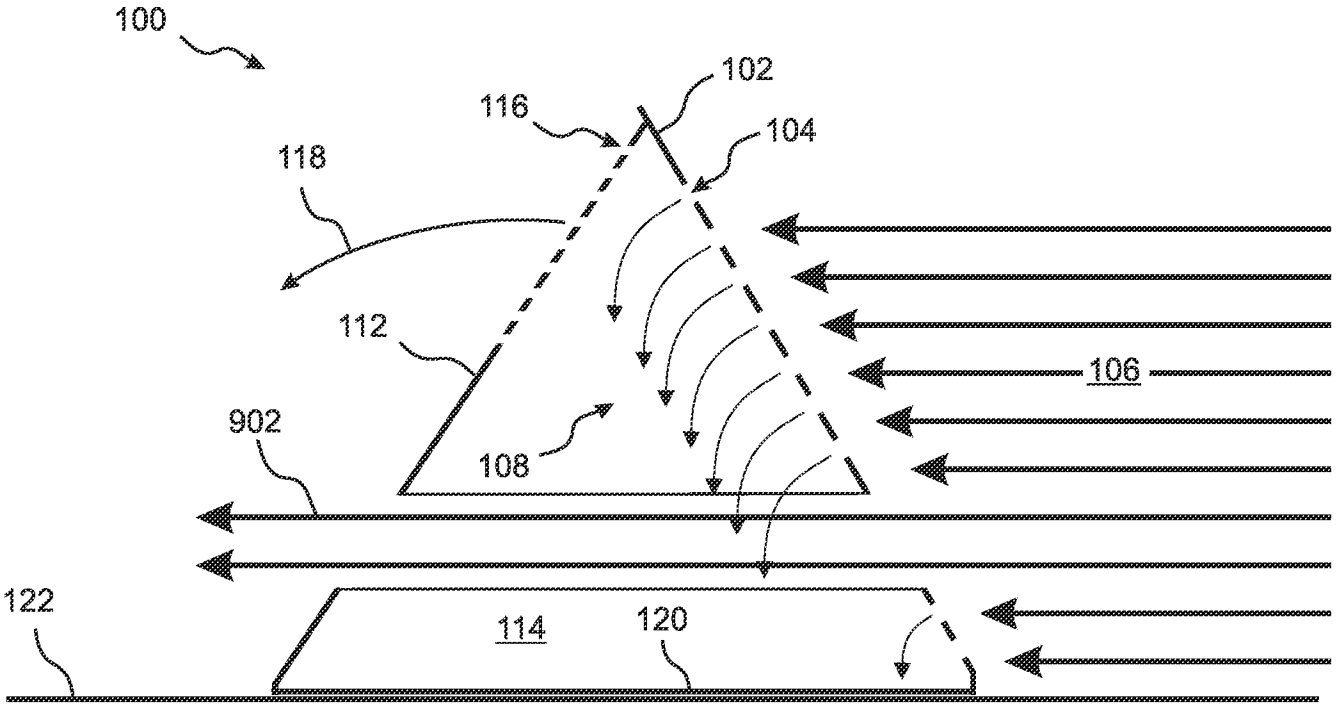
FIG. 18 is a perspective view similar to FIG. 17, showing the interaction of the barrier apparatus with oncoming mud.

With reference to FIGS. 16 through 18, so as to resist the energy of larger mudslides, some embodiments of the disclosed barrier apparatus 100 include passages 900 that allow a portion of the impacting mud to flow through the barrier apparatus 100 largely unimpeded, thereby reducing the energy that is applied to the barrier apparatus 100. In the embodiment of FIGS. 16 through 18, the passages are formed as solid-walled tubes 900 that penetrate from the barrier wall 102 to the rear wall 112. FIG. 16 is a perspective view of the illustrated embodiment, while FIG. 17 is a cross-sectional view of the embodiment of FIG. 16 taken through one of the passages 900. FIG. 18 illustrates the interaction of a mudslide 106 with the embodiment of FIG. 17. As can be seen in FIG. 18, mud entering the interior chamber 114 of the barrier apparatus 100 through large holes 104 that are above the passages 900 fall onto and slide around and past the tubular passages 900 to reach the lower region of the interior chamber 114, while mud 902 that strikes one of the passages 900 flows directly through the passage 900 and beyond the barrier apparatus 100 substantially unhindered by the barrier structure.

Additionally, mud from larger mudslides can flow over the top of the barrier wall, further limiting the fractional amount of mudslide energy that is applied to the barrier apparatus.

Figure 19:
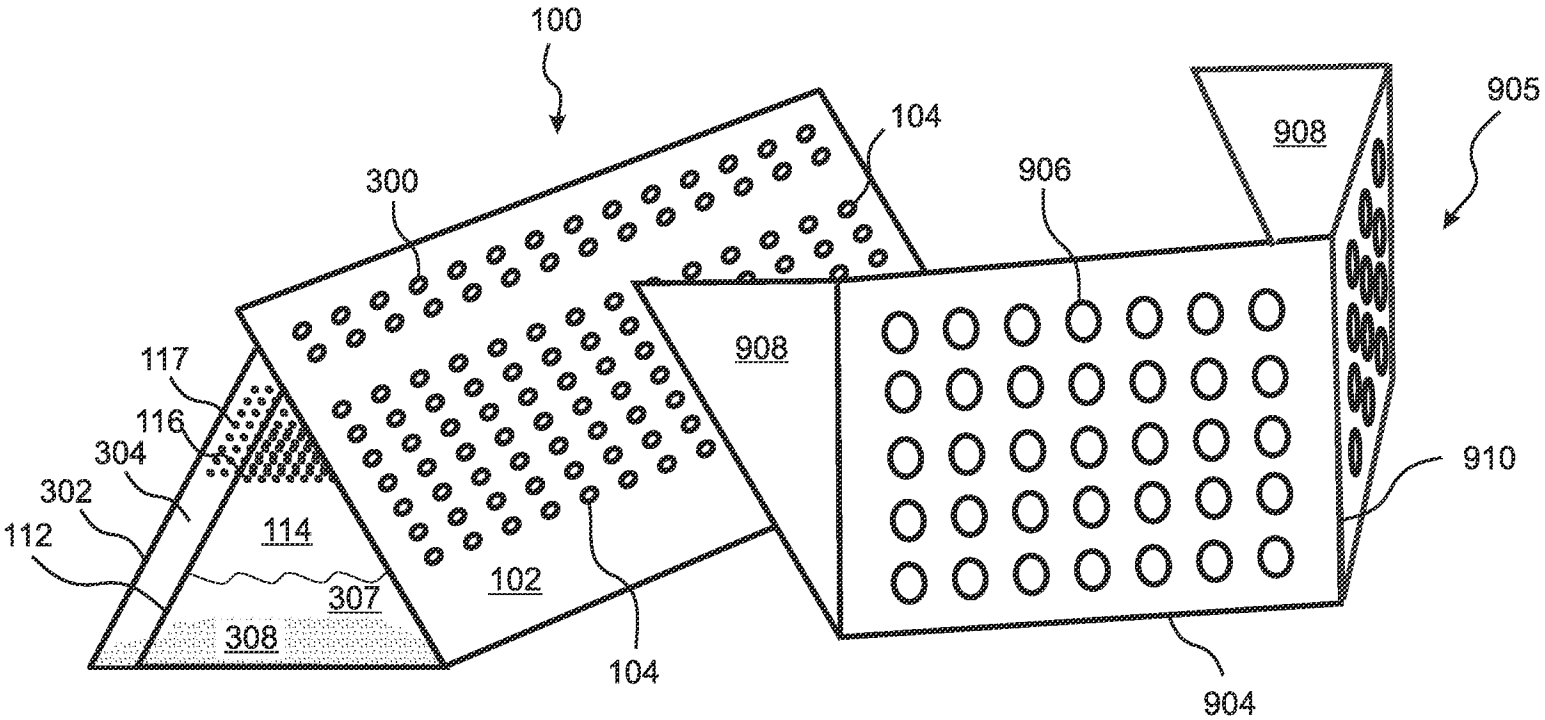
FIG. 19 is a perspective view of a barrier structure similar to FIG. 4, shown with a diverting wedge positioned in front of the barrier structure.
Figure 20:
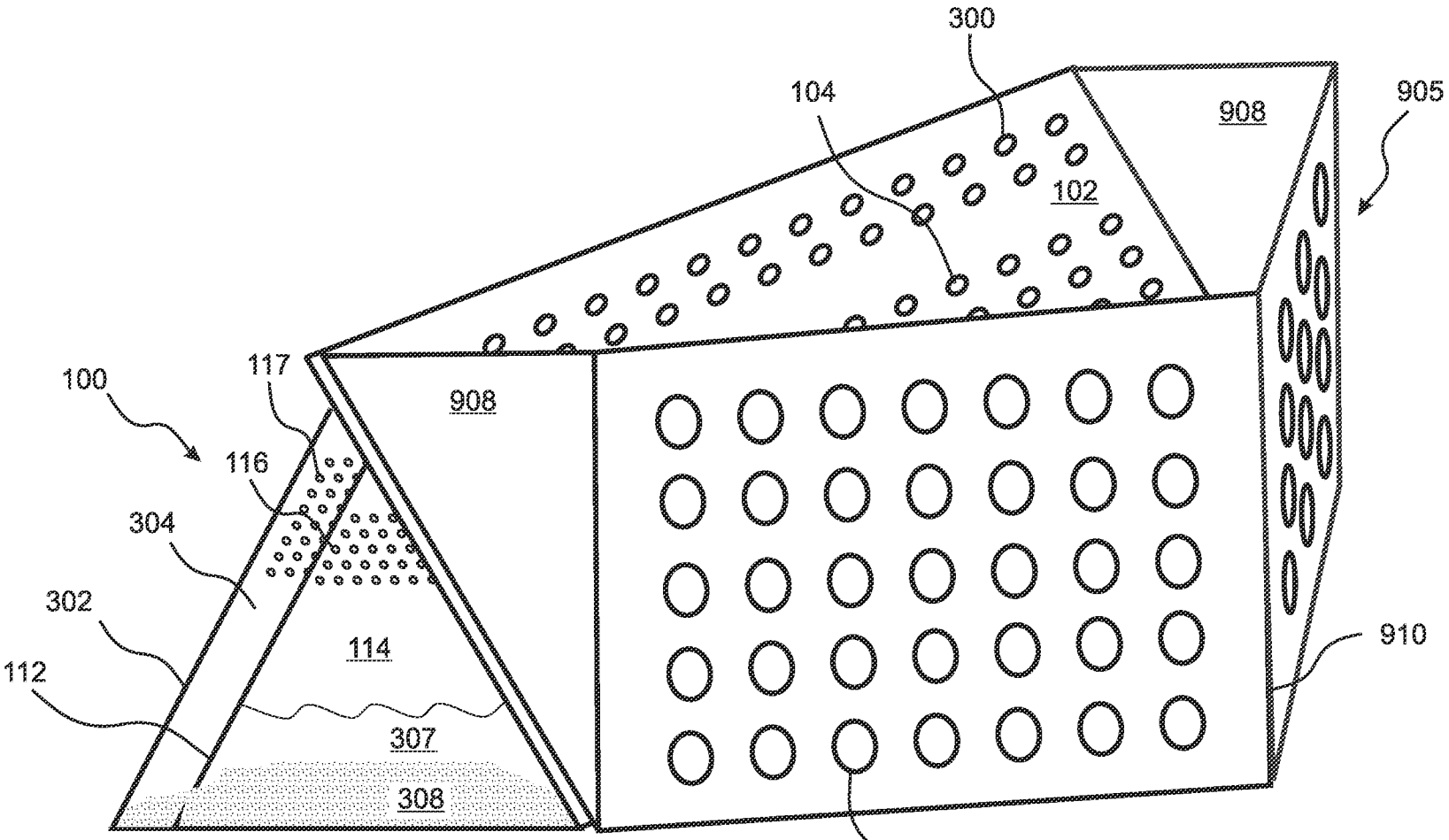
FIG. 20 is a perspective view of the embodiment of FIG. 19, shown with the diverting wedge in contact with and extending uphill from the barrier apparatus.
Figure 21:
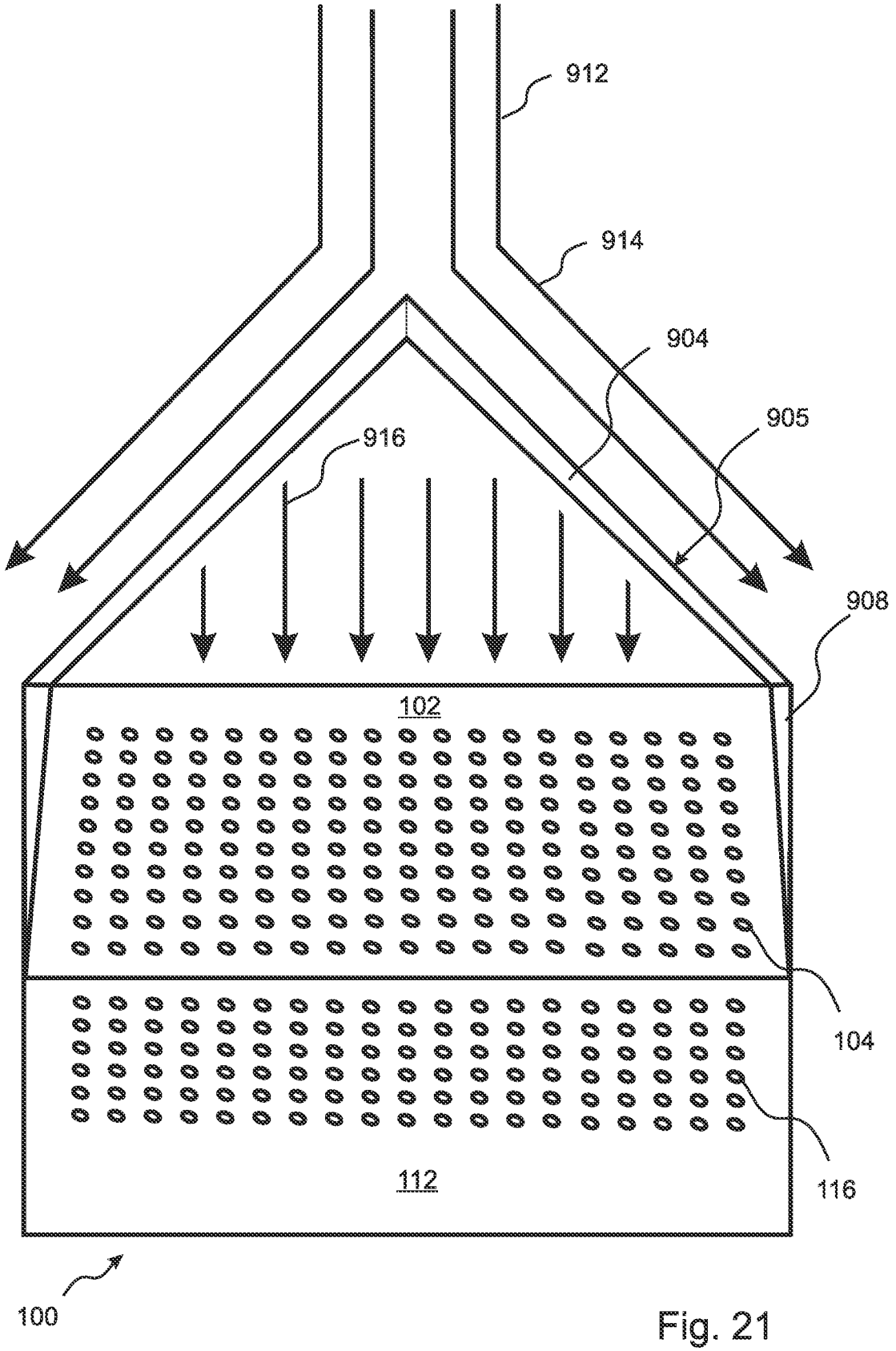
FIG. 21 is a top view showing the interaction of mud with the diverting wedge.

With reference to FIGS. 19 through 21, in embodiments the barrier structure further includes a diverting wedge 905 located uphill of the barrier apparatus 100, and configured as a pair of joined diverting walls 904 that are penetrated by wedge holes 906 and share a common uphill edge 910, with the other edges being downhill, and on either side thereof. In the illustrated embodiment, additional side panels 908 are included in the diverting wedge 905 that enable the walls 904 of the diverting wedge 905 to extend to the barrier wall 102 of the barrier apparatus, so that the diverting wedge 905 is stabilized by the mass of the materials that are collected within the barrier apparatus 100. In the perspective view of FIG. 19, the diverting wedge 904 is shown positioned in front of the barrier apparatus 100, while in perspective view of FIG. 20 the diverting wedge 904 is shown abutting the barrier wall 102 of the barrier apparatus 100.

As can be seen in the top view of FIG. 21, the diverting walls 904 are configured as a wedge 905 that re-directs and diverts incoming debris 914, and some incoming mud 914, to either side of the barrier apparatus 100, while allowing a remainder of the mud 916 to pass through the wedge holes 906 and continue, with reduced energy, to the barrier apparatus 100.

Figure 22:
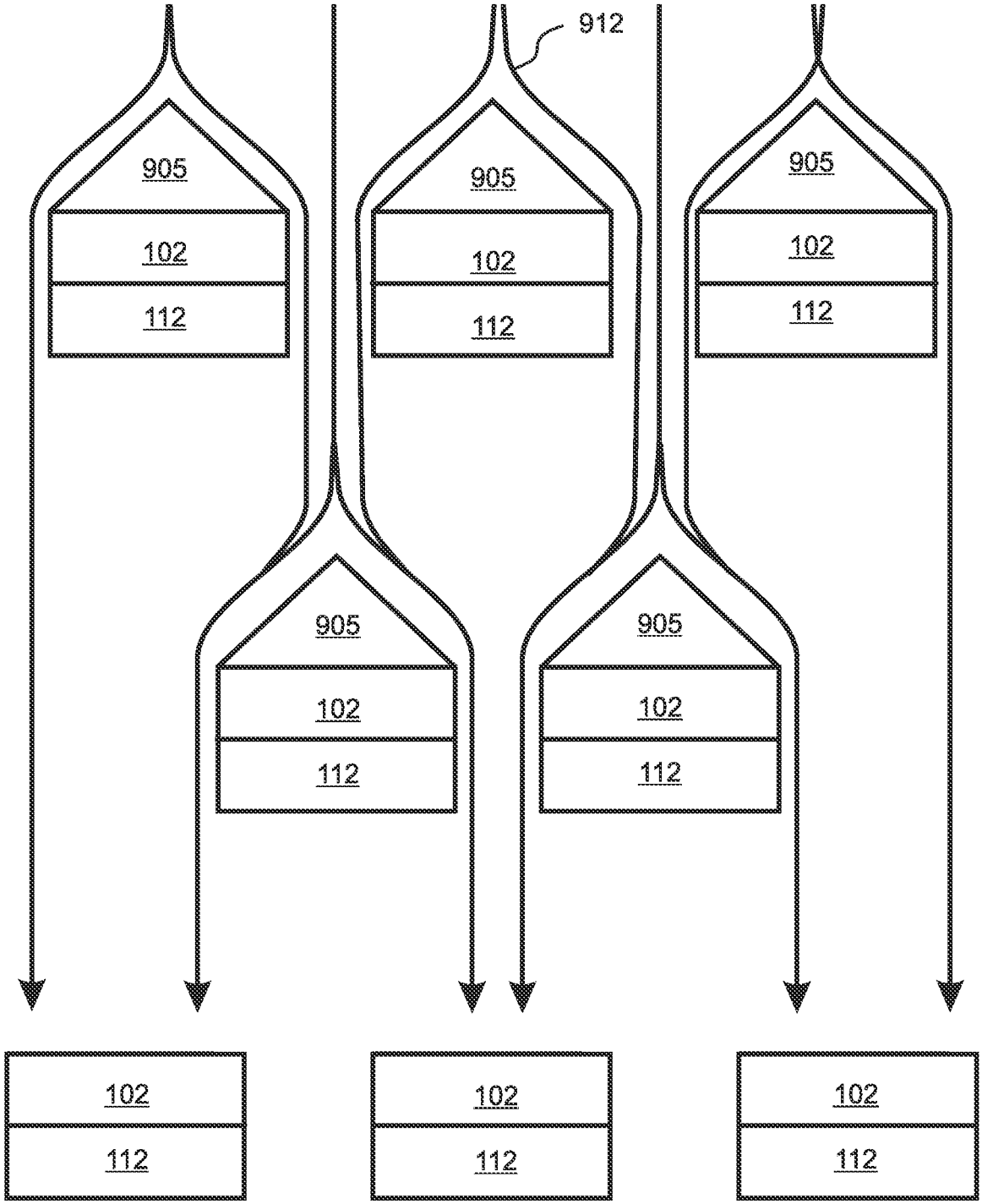
FIG. 22 is a top view showing the interaction of a mudslide with a plurality of barrier structures arranged in successive rows.

With reference to FIG. 22, in various method embodiments a plurality of the disclosed barrier structures are implemented to mitigate mudslides, extending from at least one uphill barrier structure to at least one downhill barrier structure. As is illustrated in the figure, the mud 912 from a mudslide serially encounters the plurality of barrier structures as it flows downhill. According to this approach, each of the barrier structures is required to withstand only a fraction of the total mudslide energy, while additional mud flowing over, under, and/or around each barrier structure continues downhill to the next barrier structure in the series. In the embodiment of FIG. 22, the first two rows of barrier structures include deflecting wedges 905, while the downhill row of barrier structures are able to resist the remaining energy of a mudslide without requiring deflecting wedges 905.

Figure 23:
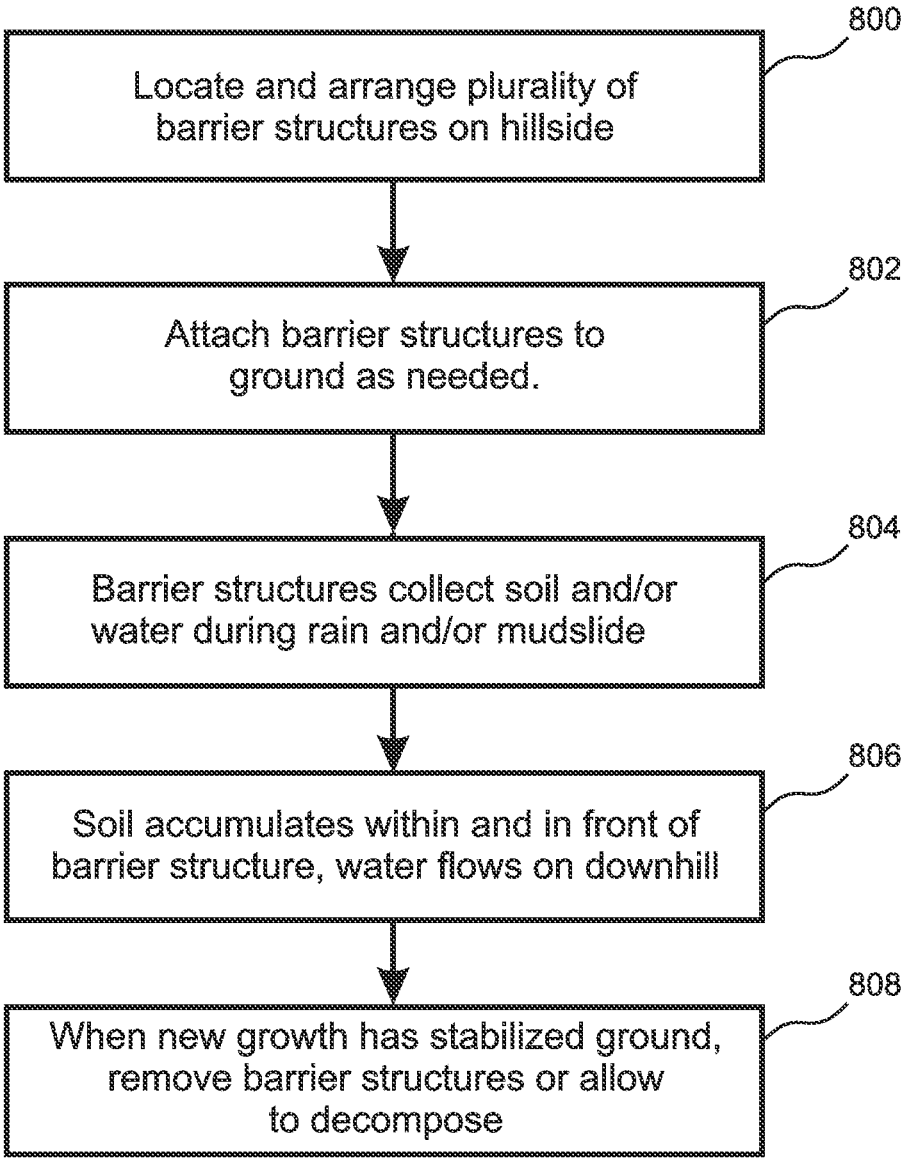
FIG. 23 is a flow diagram that illustrates a method embodiment of the present invention.

With reference to FIG. 23, in method embodiments, after a heavy rain or forest fire, or anytime a slope is at risk of mudslides, a plurality of the disclosed barrier structures can be located and arranged 800 on the slope, and attached 802 to the ground, e.g. by stakes, if and as needed. During a subsequent heavy rain or mudslide, the barrier structures collect soil and/or water 804 within their interiors and, in embodiments, within underlying reservoirs, thereby increasing the effective masses of the barrier structures and stabilizing them against the energy of future mudslides. As one or more mudslides are subsequently encountered, soil accumulates 806 within the barrier structures, displacing water as the soil settles and the water flows out through the various holes that are provided. Soil and debris also accumulate in front of the barrier structures and further help to block the mudslides. Finally, once new growth has broken through the underlying hydrophobic layer and stabilized the ground 808, so that the danger of mudslides has abated, the barrier structures can either be emptied and removed or, if the barrier structures are made from biodegradable materials, they can simply be left to decompose.

It should be noted that the term "barrier structure" is used herein to refer to the entire structure that is implemented to block mudslides, whereas the term "barrier apparatus" is used herein to refer specifically to the structure that includes a barrier wall 102, a rear wall 112, and possibly a backstop wall. Any given barrier structure will include a barrier apparatus, and may also include, in any combination, an underlying reservoir, a rear extension, and/or a deflecting wedge.

The foregoing description of the embodiments of the invention has been presented for the purposes of illustration and description. Each and every page of this submission, and all contents thereon, however characterized, identified, or numbered, is considered a substantive part of this application for all purposes, irrespective of form or placement within the application.

The invention illustratively disclosed herein suitably may be practiced in the absence of any element which is not specifically disclosed herein and is not inherently necessary. However, this specification is not intended to be exhaustive. Although the present application is shown in a limited number of forms, the scope of the invention is not limited to just these forms, but is amenable to various changes and modifications without departing from the spirit thereof. One of ordinary skill in the art should appreciate after learning the teachings related to the claimed subject matter contained in the foregoing description that many modifications and variations are possible in light of this disclosure. Accordingly, the claimed subject matter includes any combination of the above-described elements in all possible variations thereof, unless otherwise indicated herein or otherwise clearly contradicted by context. In particular, the limitations presented in dependent claims below can be combined with their corresponding independent claims in any number and in any order without departing from the scope of this disclosure, unless the dependent claims are logically incompatible with each other.

What is claimed is:

1. A barrier structure for reducing erosion due to mudslides on a slope having a slope direction that is inclined at a slope inclination angle, the barrier structure comprising a barrier apparatus that includes:

a barrier wall having a top and a bottom, the barrier wall being inclined at an angle that exceeds the slope inclination angle by least 20 degrees;

a first plurality of holes penetrating the barrier wall;

a rear wall having a top and a bottom, the rear wall being inclined at an angle that is less than the slope inclination angle, the rear wall being located behind the barrier wall with the top of the rear wall extending to an upper region of the barrier wall so that a chamber space is formed between and bounded by the barrier wall and the rear wall; and a second plurality of holes penetrating the apparatus rear wall, the holes of the second plurality of holes being smaller in diameter than the holes of the first plurality of holes, the first plurality of holes being configured to allow mud to flow through the barrier wall and into the chamber space, and the second plurality of holes being configured to allow water to flow through the apparatus rear wall out of the chamber space.

2. The barrier structure of claim 1, wherein the chamber space is further bounded by at least one side wall.

3. The barrier structure of claim 1, further comprising an underlying water reservoir located beneath the chamber space and fixed to the barrier wall and apparatus rear wall, the underlying water reservoir being configured to receive and be filled with at least one of mud and water that flows through the second plurality of holes out of the chamber space or over the top of the barrier wall.

4. The barrier structure of claim 1, further comprising a barrier extension comprising:

an extension top penetrated by a third plurality of holes; and an extension rear wall extending downward from a rear edge of the extension top;

a front edge of the extension top being configured to abut the top of the barrier wall when the barrier extension is installed behind the barrier apparatus, such that mud flowing over the top of the barrier wall flows across the extension top.

5. The system of claim 4, wherein the barrier extension further comprises a pair of opposing extension side walls.

6. The barrier structure of claim 1, wherein all components of the barrier structure are made from biodegradable materials.

7. The barrier structure of claim 1, further comprising a plurality of anchoring stakes configured to anchor the barrier structure to the slope.

8. The barrier structure of claim 1, wherein the barrier wall and rear wall can be pivoted about their bottoms so as to overlap with each other in a substantially flat, folded configuration.

9. The barrier structure of claim 1, wherein the barrier apparatus further comprises an open passage that penetrates through the barrier apparatus and is configured to allow a fraction of mud impacting the barrier wall to proceed past the barrier apparatus substantially unimpeded by the barrier apparatus.

10. The barrier structure of claim 1, further comprising a diverting wedge extending uphill from the barrier wall, the diverting wedge comprising a pair of diverting walls that are penetrated by a fourth plurality of holes, the diverting walls being inclined toward each other at substantially equal and opposite angles relative to the slope direction so that they meet at a common uphill edge, the diverting wedge being configured to allow some mud from a mudslide to pass through the fourth plurality of holes and continue to the barrier wall, while diverting a remainder of mud and debris of the mudslide to either side of the barrier wall.

11. A method of reducing erosion due to mudslides on a slope having a slope direction that is inclined at a slope inclination angle, the method comprising:

providing a barrier structure that includes a barrier apparatus, the barrier apparatus comprising:

a barrier wall having a top and a bottom, the barrier wall being inclined at an angle that exceeds the slope inclination angle by least 20 degrees;

a first plurality of holes penetrating the barrier wall;

a rear wall having a top and a bottom, the rear wall being inclined at an angle that is less than the slope inclination angle, the rear wall being located behind the barrier wall with the top of the rear wall extending to an upper region of the barrier wall so that a chamber space is formed between and bounded by the barrier wall and the rear wall; and a second plurality of holes penetrating the apparatus rear wall, the holes of the second plurality of holes being smaller in diameter than the holes of the first plurality of holes, the first plurality of holes being configured to allow mud to flow through the barrier wall and into the chamber space, and the second plurality of holes being configured to allow water to flow through the apparatus rear wall out of the chamber space;

installing the barrier apparatus on a slope that is subject to mudslides;

allowing mud to flow through the barrier wall and into the chamber space;

allowing water included in the mud within the chamber space to separate from soil included in the mud within the chamber space; and allowing the water within the chamber space to flow out of the chamber space through the second plurality of holes, while the soil within the chamber space is retained therein;

the retained soil thereby being added to the effective weight of the barrier apparatus and thereby increasing a stability of the barrier structure.

12. The method of claim 11, further comprising, after a danger of mudslides has abated, emptying the retained soil from the barrier chamber and removing the barrier apparatus from the slope.

13. The method of claim 11, wherein the barrier structure is constructed from biodegradable materials, and wherein the method further comprises, after a danger of mudslides has abated, allowing the barrier structure to decompose into the slope.

14. The method of claim 11, wherein the barrier structure further includes a diverting wedge extending uphill from the barrier wall, the diverting wedge comprising a pair of diverting walls that are penetrated by a fourth plurality of holes, the diverting walls being inclined toward each other at substantially equal and opposite angles relative to the slope direction so that they meet at a common uphill edge;

and wherein the method further includes causing the diverting wedge to allow some mud from a mudslide to pass through the fourth plurality of holes and continue to the barrier wall, while diverting a remainder of mud and debris of the mudslide to either side of the barrier wall.

15. A method of reducing erosion due to mudslides on a slope having a slope direction that is inclined at a slope inclination angle, the method comprising:

installing a plurality of barrier structures on the slope, the plurality of barrier structures comprising at least one uphill barrier structure that is uphill of at least one downhill barrier structure, each of the uphill and downhill barrier structures comprising a barrier apparatus that includes:

a barrier wall having a top and a bottom, the barrier wall being inclined at an angle that exceeds the slope inclination angle by least 20 degrees;

a first plurality of holes penetrating the barrier wall;

a rear wall having a top and a bottom, the rear wall being inclined at an angle that is less than the slope inclination angle, the rear wall being located behind the barrier wall with the top of the rear wall extending to an upper region of the barrier wall so that a chamber space is formed between and bounded by the barrier wall and the rear wall; and a second plurality of holes penetrating the apparatus rear wall, the holes of the second plurality of holes being smaller in diameter than the holes of the first plurality of holes, the first plurality of holes being configured to allow mud to flow through the barrier wall and into the chamber space, and the second plurality of holes being configured to allow water to flow through the apparatus rear wall out of the chamber space;

allowing mud from a mudslide to impact the uphill barrier structure such that a first portion of the mud enters the chamber space of the uphill barrier structure while a second portion of the mud passes over, around, or through the uphill barrier structure; and allowing the second portion of the mud to impact the downhill barrier structure.

16. The method of claim 15, wherein the uphill barrier structure includes at least one of:

an open passage that penetrates through the barrier apparatus of the uphill barrier structure and is configured to allow at least some of the second portion of the mud to proceed past the uphill barrier apparatus substantially unimpeded by the uphill barrier apparatus; and a diverting wedge extending uphill from the barrier wall of the uphill barrier structure, the diverting wedge comprising a pair of diverting walls that are penetrated by a fourth plurality of holes, the diverting walls being inclined toward each other at substantially equal and opposite angles relative to the slope direction so that they meet at a common uphill edge, the diverting wedge being configured to allow the first portion of the mud to pass through the fourth plurality of holes and continue to the barrier wall, while diverting at least part of the second portion of the mud to either side of the barrier wall.

17. The method of claim 15, wherein the downhill barrier structure does not include either of an open passage and a diverting wedge.

* * * * *